US009010135B2

(12) United States Patent
Kawano et al.

(10) Patent No.: US 9,010,135 B2
(45) Date of Patent: Apr. 21, 2015

(54) REFRIGERATION APPARATUS WITH A REFRIGERANT COLLECTION OPERATION BETWEEN A PLURALITY OF OUTDOOR UNITS

(75) Inventors: Satoshi Kawano, Osaka (JP); Shinya Matsuoka, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 1253 days.

(21) Appl. No.: 12/524,454

(22) PCT Filed: Jan. 11, 2008

(86) PCT No.: PCT/JP2008/050267

§ 371 (c)(1),
(2), (4) Date: Jul. 24, 2009

(87) PCT Pub. No.: WO2008/090773

PCT Pub. Date: Jul. 31, 2008

(65) Prior Publication Data

US 2010/0107665 A1 May 6, 2010

(30) Foreign Application Priority Data

Jan. 26, 2007 (JP) ..... 2007-016900

(51) Int. Cl.

*F25B 41/00* (2006.01)
*F25B 13/00* (2006.01)
*F25B 45/00* (2006.01)

(52) U.S. Cl.

CPC ..... *F25B 13/00* (2013.01); *F25B 45/00* (2013.01); *F25B 2313/005* (2013.01); (Continued)

(58) Field of Classification Search

CPC .... F25B 13/00; F25B 45/00; F25B 2313/005; F25B 2313/007; F25B 2313/0231; F25B 2313/025; F25B 2313/02371; F25B 2313/02732; F25B 2313/0294; F25B 2400/19; F25B 2600/05; F25B 2700/19; F25B 2700/1931

USPC ..... 62/175, 196.4, 503, 510, 513

See application file for complete search history.

(56) References Cited

U.S. PATENT DOCUMENTS 5,142,877 A * 9/1992 Shimizu ..... 62/129
5,263,333 A * 11/1993 Kubo et al. ..... 62/160

(Continued)

FOREIGN PATENT DOCUMENTS

EP 1775532 A1 * 4/2007
EP 1818627 A1 * 8/2007

(Continued)

*Primary Examiner* — Marc Norman
*Assistant Examiner* — Paolo Gonzalez
(74) *Attorney, Agent, or Firm* — Birch, Stewart, Kolasch & Birch, LLP

(57) ABSTRACT

To a refrigerant circuit of an air conditioner as a refrigerating apparatus, a plurality of outdoor units are connected. In an operation state where the first outdoor unit is operated with the second outdoor unit stopped, the air conditioner performs refrigerant collection operation for collecting and retaining surplus refrigerant to and in a second outdoor heat exchanger of the second outdoor unit. During the refrigerant collection operation, a second outdoor expansion valve is closed fully, and a second outdoor fan is operated. Part of refrigerant discharged from a first compressor flows into the second outdoor heat exchanger during the refrigerant collection operation. The refrigerant flowing in the second outdoor heat exchanger dissipates heat to outdoor air to be condensed. Since the second outdoor expansion valve is closed fully, the condensed refrigerant is retained in the second outdoor heat exchanger.

5 Claims, 14 Drawing Sheets

(52) U.S. Cl.
CPC .. *F25B 2313/007* (2013.01); *F25B 2313/0231* (2013.01); *F25B 2313/025* (2013.01); *F25B 2313/02731* (2013.01); *F25B 2313/02732* (2013.01); *F25B 2313/0294* (2013.01); *F25B 2400/19* (2013.01); *F25B 2600/05* (2013.01); *F25B 2700/19* (2013.01); *F25B 2700/1931* (2013.01)

(56) References Cited

U.S. PATENT DOCUMENTS

| | | | | | |
|---|---|---|---|---|---|
| 5,361,595 | A | | 11/1994 | Shimura et al. | |
| 5,467,604 | A | * | 11/1995 | Sekigami et al. | 62/117 |
| 5,490,399 | A | * | 2/1996 | Sada | 62/510 |
| 5,526,649 | A | * | 6/1996 | Sada | 62/175 |
| 5,548,968 | A | * | 8/1996 | Sada | 62/175 |
| 6,058,728 | A | * | 5/2000 | Takano et al. | 62/196.4 |
| 6,266,965 | B1 | | 7/2001 | Takano et al. | |
| 6,581,408 | B1 | * | 6/2003 | Tadano et al. | 62/513 |
| 6,935,125 | B2 | * | 8/2005 | Wakuda | 62/160 |
| 7,140,198 | B2 | * | 11/2006 | Matsuoka et al. | 62/498 |
| 2001/0000050 | A1 | * | 3/2001 | Okazaki et al. | 62/149 |
| 2005/0252221 | A1 | * | 11/2005 | Mizutani et al. | 62/149 |
| 2006/0080989 | A1 | * | 4/2006 | Aoki et al. | 62/324.4 |
| 2006/0123809 | A1 | * | 6/2006 | Ha et al. | 62/149 |

FOREIGN PATENT DOCUMENTS

| | | | | |
|---|---|---|---|---|
| JP | 5-164437 | A | | 6/1993 |
| JP | 5-288422 | A | | 11/1993 |
| JP | 2000-146346 | A | | 5/2000 |
| JP | 2001-12830 | A | | 1/2001 |
| JP | 2002-243301 | A | | 8/2002 |
| WO | WO 2005121664 | A1 | * | 12/2005 |
| WO | WO 2006057111 | A1 | * | 6/2006 |

* cited by examiner

REFRIGERATION APPARATUS WITH A REFRIGERANT COLLECTION OPERATION BETWEEN A PLURALITY OF OUTDOOR UNITS

BACKGROUND OF THE INVENTION

1. Technical Field

The present disclosure relates to refrigerating apparatuses performing refrigeration cycles by circulating refrigerant in refrigerant circuits.

2. Background Art

Refrigerating apparatuses performing refrigeration cycles by circulating refrigerant in refrigerant circuits have been known conventionally, and are being used widely as air conditioners and the like. Patent Documents 1 and 2 disclose air conditioners configured by such refrigerating apparatuses.

In a refrigerant circuit of the air conditioner disclosed in Japanese Unexamined Patent Application Publication No. 2002-243301, two indoor units are connected in parallel to one outdoor unit. The operation of this air conditioner can be selected between operation where both the two indoor units are operated and operation where only one of the indoor units is operated. The amount of the refrigerant necessary for performing the refrigeration cycle in the refrigerant circuit decreases as the number of operated indoor units is reduced. In view of this, a receiver is provided in the outdoor unit of the air conditioner for collecting and storing surplus refrigerant when the number of operated indoor units is reduced.

The air conditioner disclosed in Japanese Unexamined Patent Application Publication No. 2000-146346 includes two outdoor units including heat source side heat exchangers. In a refrigerant circuit of this air conditioner, the two heat source side heat exchangers are connected in parallel to each other, and two user side heat exchangers installed indoors are connected in parallel to each other. In this air conditioner, receivers are provided in the outdoor units for the purpose of adjusting the amount of the refrigerant in the refrigerant circuit according to the operation state.

BRIEF SUMMARY OF THE INVENTION

Problems that the Invention is to Solve

However, such receivers in the refrigerant circuits can cause disadvantages, which will be described below.

In general, the receivers are provided in high pressure lines of the refrigerant circuits, and high pressure liquid refrigerant is retained in the receivers. Since the temperature of the high pressure liquid refrigerant is comparatively high, the refrigerant inside the receivers will dissipate heat. For this reason, in operation utilizing heat, such as heating operation in air conditioners, part of the heat that the refrigerant has may be lost in the receivers. Further, provision of the receivers in the refrigerant circuits may increase the number of components to be connected to the refrigerant circuits, thereby increasing the manufacturing cost.

The present invention has been made in view of the foregoing, and it objective is to provide a refrigerating apparatus that can overcome the disadvantages caused due to the presence of a receiver by omitting the receiver from a refrigerant circuit.

Means for Solving the Problems

A first example of the present invention is directed to a refrigerating apparatus including a refrigerant circuit (20) including a compressor (32, 42), a plurality of heat source side heat exchangers (33, 43, 82), and at least one user side heat exchanger (52, 62, 72) connected to one another. In the apparatus, the refrigerating apparatus is capable of performing low power operation for performing a refrigeration cycle in the refrigerant circuit (20) in a state where at least one of the heat source side heat exchangers (33, 43, 82) is in a non-operating state, and refrigerant collection operation for collecting and retaining refrigerant to and in the heat source side heat exchanger (33, 43, 82) in the non-operating state in the low power operation.

In the first example of the present invention, a plurality of heat source side heat exchangers (33, 43, 82) are provided in the refrigerant circuit (20). In the refrigerant circuit (20), there can be perform not only the operation where all the heat source side heat exchangers (33, 43, 82) substantially function as condensers or evaporators in the refrigeration cycle but also the low power operation where some of the heat source side heat exchangers (33, 43, 82) is in the non-operating state with it not substantially functioning as a condenser or an evaporator. In the low power operation, as the number of heat source side heat exchangers (33, 43, 82) in the non-operating state is increased, the amount of the refrigerant necessary for performing the refrigeration cycle in the refrigerant circuit (20) decreases. While, since the heat transfer area of the heat source side heat exchangers (33, 43, 82) which is in contact with the refrigerant must be secured to some extent, their internal volumes are increased to some extend in general. In view of this, in the present invention, the refrigerant collection operation is performed in the low power operation for collecting and retaining surplus refrigerant to and in the heat source side heat exchanger (33, 43, 82) in the non-operating state. In other words, in this example, the amount of the refrigerant in the refrigerant circuit (20) is adjusted by utilizing a heat source side heat exchanger (33, 43, 82) in the non-operating state in the low power operation.

Referring to a second example of the present invention, the apparatus in the first example further includes control means (90) configured to judge, during the low power operation, whether an amount of the refrigerant circulating in the refrigerant circuit (20) is excessive or not, and to cause the refrigerant circuit to perform the refrigerant collection operation when it is judged that the amount of the refrigerant is excessive.

In the second example, when the control means (90) judges in the low power operation that the amount of the refrigerant circulating in the refrigerant circuit (20) is excessive, it causes the refrigerant circuit (20) to perform the refrigerant collection operation. This refrigerant collection operation collects and retains surplus refrigerant to and in the heat source side heat exchanger (33, 43, 82) in the non-operating state, thereby appropriately adjusting the amount of the refrigerant circulating in the refrigerant circuit (20).

Referring to a third example of the present invention, the apparatus in the second example further includes: high pressure detecting means (131, 141) configured to detect a physical quantity serving as an index of a high pressure of the refrigeration cycle performed in the refrigerant circuit (20), wherein the control means (90) is configured to judge, when a detected value of the high pressure detecting means (131, 141) exceeds a predetermined reference value, that the amount of the refrigerant circulating the refrigerant circuit (20) is excessive.

Here, when the amount of the refrigerant actually circulating in the refrigerant circuit (20) is excessive relative to the amount of the refrigerant necessary for performing the refrigeration cycle in an appropriate operation state, the amount of the refrigerant that can be condensed in a heat exchanger functioning as a condenser is relatively deficient, so that the high pressure of the refrigeration cycle becomes high. Conversely, when the amount of the refrigerant actually circulating in the refrigerant circuit (20) is deficient relative to the amount of the refrigerant necessary for performing the refrigeration cycle in the appropriate operation state, the amount of the refrigerant that can be condensed in a heat exchanger functioning as a condenser is relatively excessive, so that the high pressure of the refrigeration cycle becomes low. As such, the value of the high pressure of the refrigeration cycle varies according to whether the amount of the refrigerant circulating in the refrigerant circuit (20) is excessive or deficient.

In view of this, the control means (90) in the third example judges whether the amount of the refrigerant circulating in the refrigerant circuit (20) is excessive or not on the basis of the detected value of the high pressure detection means (131, 141). That is, the control means (90) judges, when a detected value of the high pressure detection means (131, 141) exceeds the predetermined reference value, that the amount of the refrigerant circulating in the refrigerant circuit (20) is excessive.

Referring to a fourth example of the present invention, in the first example, the refrigerant circuit (20) includes flow rate adjusting mechanisms (34, 44, 83) configured to individually adjust flow rates of the refrigerant at one ends of the heat source side heat exchangers (33, 43, 82), and the refrigerant collection operation is operation for supplying a cooling fluid for cooling the refrigerant to the heat source side heat exchanger (33, 43, 82) in a state where refrigerant flow on one end side of the heat source side heat exchanger (33, 43, 82) in the non-operating state in the low power operation is limited or blocked by a corresponding flow rate adjusting mechanism (34, 44, 82) with the other end side thereof communicating with a discharge side of the compressor (32, 42).

In the fourth example, the flow rate adjusting mechanisms (34, 44, 83) are provided in the refrigerant circuit (20). During the refrigerant collection operation, the refrigerant flow on the one end side of the heat source side heat exchanger (33, 43, 83) in the non-operating state is limited or blocked by the corresponding flow rate adjusting mechanism (34, 44, 83). On the other hand, the other end side thereof communicates with the discharge side of the corresponding compressor (32, 42). Into the heat source side heat exchanger (33, 43, 82) in the non-operating state, the refrigerant discharged from the compressor (32, 42) flows from the other end side thereof. Further, the cooling fluid is supplied to the heat source side heat exchanger in the non-operating state. The refrigerant flowing in the heat source side heat exchanger (33, 43, 82) in the non-operating state dissipates heat to the cooling fluid to be condensed, thereby being retained in the heat source side heat exchanger (33, 43, 82).

Referring to a fifth example of the present invention, the apparatus in the fourth example further includes: high pressure detecting means (131, 141) configured to detect a physical quantity serving as an index of a high pressure of the refrigeration cycle performed in the refrigerant circuit (20); and control means (90) configured to adjust, during the refrigerant collection operation, a flow rate of the cooling fluid supplied to the heat source side heat exchanger (33, 43, 82) in the non-operating state on the basis of a detected value of the high pressure detecting means (131, 141).

In the fifth example, the high pressure detecting means (131, 141) detects the physical quantity serving as an index of the high pressure of the refrigeration cycle. The physical quantity serving as an index of the high pressure of the refrigeration cycle may be the refrigerant pressures on the discharge sides of the compressors (32, 42), the refrigerant pressures before and after a heat exchanger serving as a condenser, the condensation temperature of the refrigerant in a heat exchanger serving as a condenser, and the like. In this example, the control means (90) adjusts the flow rate of the cooling fluid supplied to the heat source side heat exchanger (33, 43, 82) in the non-operating state on the basis of the detected value of the high pressure detecting means (131, 141) during the refrigerant collection operation.

As described above, the value of the high pressure of the refrigeration cycle varies according to whether the amount of the refrigerant circulating in the refrigerant circuit (20) is excessive or deficient. While, when the flow rate of the cooling fluid supplied to the heat source side heat exchanger (33, 43, 82) in the non-operating state is changed in the refrigerant collection operation, the amount of the refrigerant retained in the heat source side heat exchanger (33, 43, 82) in the non-operating state varies.

In view of this, the control means (90) in the fifth example adjusts the flow rate of the cooling fluid supplied to the heat source side heat exchanger (33, 43, 82) in the non-operating state on the basis of the detected value of the high pressure detecting means (131, 141) during the refrigerant collection operation, thereby controlling the amount of the refrigerant retained in the heat source side heat exchanger (33, 43, 82) in the non-operating state.

Referring to a sixth example of the present invention, in the fifth example, the heat source side heat exchangers (33, 43, 82) are configured to heat exchange the refrigerant with outdoor air, air blowing mechanisms (37, 47, 85) are provided for supplying outdoor air to the heat source side heat exchangers (33, 43, 82), and the control means (90) is configured to adjust, during the refrigerant collection operation, a flow rate of the outdoor air supplied as the cooling fluid to the heat source side heat exchanger (33, 43, 82) in the non-operating state by controlling operation of a corresponding air blowing mechanism (37, 47, 85).

In the sixth example, the control means (90) controls the operation of the air blowing mechanisms (37, 47, 85) during the refrigerant collection operation, thereby adjusting the flow rate of the outdoor air supplied to the heat source side heat exchanger (33, 43, 82) in the non-operating state. When the flow rate of the outdoor air supplied to the heat source side heat exchanger (33, 43, 82) in the non-operating state is changed, the amount of heat that the refrigerant flowing in the heat source side heat exchanger (33, 43, 82) in the non-operating state dissipates to outdoor air varies. This condenses the refrigerant in the heat source side heat exchanger (33, 43, 82) in the non-operating state, thereby changing the amount of the refrigerant retained therein.

Referring to a seventh example of the present invention, in the fourth example, the flow rate adjusting mechanisms are configured by opening variable adjusting valves (34, 44, 83), and the apparatus further includes: subcooling degree detecting means (131, 134, 141, 144) configured to detect degrees of subcooling of the refrigerant flowing out from the heat source side heat exchangers (33, 43, 82); and control means (90) configured to adjust, during the refrigerant collection operation, an opening of an adjusting valve (34, 44, 83) provide at one end of the heat source side heat exchanger (33, 43, 82) in the non-operating state on the basis of the degree of subcooling detected by subcooling degree detecting means (131, 134, 141, 14) corresponding to the heat source side heat exchanger (33, 43, 82) in the non-operating state.

In the seventh example, the control means (90) adjusts the opening of the adjusting valve (34, 44, 83) provided correspondingly to the heat source side heat exchanger (33, 43, 82)

in the non-operating state (that is, the heat source side heat exchanger into and in which the refrigerant is collected and retained) during the refrigerant collection operation. If the refrigerant flow on the one side of the heat source side heat exchanger (33, 43, 82) in the non-operating state is not blocked completely during the refrigerant collection operation, the liquid refrigerant flows out little by little from the heat source side heat exchanger (33, 43, 82) in the non-operating state through the corresponding adjusting valve (34, 44, 83). When the opening of the adjusting valve (34, 44, 83) corresponding to the heat source side heat exchanger (33, 43, 82) in the non-operating state is changed, the flow rate of the refrigerant passing through the adjusting valve (34, 44, 83) varies, thereby changing the amount of the refrigerant retained in the heat source side heat exchanger (33, 43, 82) in the non-operating state.

Here, the degree of subcooling of the refrigerant flowing out from the heat source side heat exchanger (33, 43, 82) in the non-operating state varies according to the amount of the liquid refrigerant retained in the heat source side heat exchanger (33, 43, 82) in the non-operating state. Specifically, the larger the amount of the refrigerant retained in the heat source side heat exchanger (33, 43, 82) in the non-operating state is, the higher the degree of subcooling of the refrigerant flowing out therefrom is. Conversely, the smaller the amount of the refrigerant retained in the heat source side heat exchanger (33, 43, 82) in the non-operating state is, the lower the degree of subcooling of the refrigerant flowing out therefrom is.

Thus, the degree of subcooling of the refrigerant flowing out from the heat source side heat exchanger (33, 43, 82) in the non-operating state can serve as an index indicating the amount of the refrigerant retained in the heat source side heat exchanger (34, 44, 82) in the non-operating state. In view of this, the control means (90) in the seventh example adjusts the opening of the adjusting valve (34, 44, 83) corresponding to the heat source side heat exchanger (34, 44, 82) in the non-operating state according to the degree of subcooling of the refrigerant flowing out from the heat source side heat exchanger (33, 43, 82) in the non-operating state.

Referring to an eighth example of the present invention, in the fourth example, the flow rate adjusting mechanisms are configured by opening variable adjusting valves (34, 44, 83), and the apparatus further includes: subcooling degree detecting means (131, 134, 141, 144) configured to detect degrees of subcooling of the refrigerant flowing out from the heat source side heat exchangers (33, 43, 82); and control means (90) configured to adjust, during the refrigerant collection operation, an opening of an adjusting valve (34, 44, 83) provide at one end of the heat source side heat exchanger (33, 43, 82) in the non-operating state on the basis of the degree of subcooling detected by subcooling degree detecting means (131, 134, 141, 144) corresponding to a heat source side heat exchanger (33, 43, 82) in an operating state.

In the eighth example, the control means (90) adjusts the opening of the adjusting valve (34, 44, 83) corresponding to the heat source side heat exchanger (33, 43, 82) in the non-operating state (that is, a heat source side heat exchanger into and in which the refrigerant is collected and retained) during the refrigerant collection operation. If the refrigerant flow on the one side of the heat source side heat exchanger (33, 43, 82) in the non-operating state is not blocked completely during the refrigerant collection operation, the liquid refrigerant flows out little by little from the heat source side heat exchanger (33, 43, 82) in the non-operating state through the corresponding adjusting valve (34, 44, 83). When the opening of the adjusting valve (34, 44, 83) corresponding to the heat source side heat exchanger (33, 43, 82) in the non-operating state is changed, the flow rate of the refrigerant passing through the adjusting valve (34, 44, 83) varies, thereby changing the amount of the refrigerant retained in the heat source side heat exchanger (33, 43, 82) in the non-operating state.

Here, the degree of subcooling of the refrigerant flowing out from the heat source side heat exchanger (33, 43, 82) in the operating state functioning as a condenser varies according to the amount of the liquid refrigerant present in the heat source side heat exchanger (33, 43, 82) in the operating state. Additionally, the amount of the liquid refrigerant present in the heat source side heat exchanger (33, 43, 82) in the operating state varies according to the amount of the refrigerant circulating in the refrigerant circuit (20). Specifically, when the amount of the refrigerant circulating in the refrigerant circuit (20) is larger than an appropriate value, the amount of the refrigerant present in the heat source side heat exchanger (33, 43, 82) in the operating state becomes so large to make the degree of subcooling of the refrigerant flowing therefrom to be excessive. Conversely, when the amount of the refrigerant circulating in the refrigerant circuit (20) is smaller than the appropriate value, the amount of the refrigerant present in the heat source side heat exchanger (33, 43, 82) in the operating state becomes so small to make the degree of subcooling of the refrigerant flowing therefrom to be deficient.

Thus, the degree of subcooling of the refrigerant flowing out from the heat source side heat exchanger (33, 43, 82) in the operating state functioning as a condenser can serve as an index indicating excess or deficiency of the amount of the refrigerant circulating in the refrigerant circuit (20). In view of this, the control means (90) in the eighth example adjusts the opening of the adjusting valve (34, 44, 83) corresponding to the heat source side heat exchanger (34, 44, 82) in the non-operating state according to the degree of subcooling of the refrigerant flowing out from the heat source side heat exchanger (33, 43, 82) in the operating state.

Referring to an ninth example of the present invention, in the first example, the refrigerant circuit (20) includes multiple ones of the at least one user side heat exchanger (52, 62, 72), heat source side expansion valves (34, 44, 83) provided one by one at one ends of the heat source side heat exchangers (33, 43, 82), user side expansion valves (553, 63, 73) provided one by one at one ends of the user side heat exchangers (52, 62, 72), and a liquid side pipe (25) having one branching end connected to the heat source side expansion valves (34, 44, 83), and the other branching end connected to the user side expansion valves (53, 63, 73), and the apparatus includes: control means (90) configured to perform, in an operation state where at least one of the heat source side heat exchangers (33, 43, 82) functions as a condenser, adjustment of an opening of a heat source side expansion valve (34, 44, 83) corresponding to the heat source side heat exchanger (33, 43, 83) functioning as a condenser so that a difference between a high pressure of the refrigeration cycle and a pressure of the refrigerant in the liquid side pipe (25) is equal to or larger than a predetermined first reference value and a difference between the pressure of the refrigerant in the liquid side pipe (25) and a low pressure of the refrigeration cycle is equal to or larger than a predetermined second reference value.

In the ninth example, the refrigerant circuit (20) includes a plurality of heat source side heat exchangers (33, 43, 82) and a plurality of user side heat exchangers (52, 62, 72). Assume that some of the heat source heat exchangers (33, 43, 82) functions as a condenser and some of the user side heat exchangers (52, 62, 72) functions as an evaporator in the refrigerant circuit (20) performing the refrigeration cycle. In the refrigerant circuit (20) in this state, the refrigerant condensed in the heat source side heat exchanger (33, 43, 82) functioning as a condenser is reduced in pressure when passing through the heat source side expansion valve (34, 44, 83) provided on the one side of the heat source side heat exchanger (33, 43, 82), flows through the liquid side pipe (25), is further reduced in pressure when passing through the user side expansion valve (53, 63, 73), and then flows into the user side heat exchanger (52, 62, 72) corresponding to the user side expansion valve (53, 63, 73) to be evaporated.

In the refrigerant circuit (20) in the ninth example, in the state where the plurality of heat exchangers including at least one of the heat source side heat exchangers (33, 43, 82) function as condensers, the opening adjustment of the expansion valves corresponding to the heat exchangers functioning as condensers can adjust the amount of the refrigerant distributed to the heat exchangers. Further, in the state where a plurality of heat exchangers function as evaporators in the refrigerant circuit (20), adjustment of the expansion valves corresponding to the heat exchangers functioning as evaporators can adjust the amount of the refrigerant distributed to the heat exchangers.

For adjusting the amount of the refrigerant distributed to the heat exchangers by adjusting the opening of the expansion valves in this way, there must be difference to some extent between the pressure on the upstream side and that on the downstream side of the expansion valves whose openings are to be adjusted. Too small pressure difference between the sides of an expansion valve reduces the driving force for causing the refrigerant to flow. Accordingly, change in opening of the expansion valve can change little the amount of the refrigerant passing through the expansion valve.

In view of this, the control means (90) in the ninth example adjusts the opening of the heat source side expansion valve (34, 44, 83) corresponding to the heat source side heat exchanger (33, 43, 82) functioning as a condenser to control the pressure of the refrigerant flowing in the liquid side pipe (25). The operation of the control means (90) is performed so that the difference between the high pressure of the refrigeration cycle and the pressure of the refrigerant in the liquid side pipe (25) is equal to or larger than the predetermined first reference value and the difference between the pressure of the refrigerant in the liquid side pipe (25) and the low pressure of the refrigeration cycle is equal to or larger than the predetermined second reference value.

ADVANTAGES

According to the present invention, the refrigeration collection operation in the low power operation enables the refrigerant to be collected to and retained in the heat source side heat exchanger (33, 43, 82) in the non-operating state. In other words, in the low power operation in which the amount of the refrigerant necessary for performing the refrigeration cycle decreases, surplus refrigerant can be collected to and stored in the heat source side heat exchanger (33, 43, 82) in the non-operating state. As a result, even with no receiver in the refrigerant circuit (20), the amount of the refrigerant can be adjusted by utilizing the heat source side heat exchanger (33, 43, 82) in the non-operating state. Accordingly, the present invention enables omission of any receivers from the refrigerant circuit (20), thereby implementing the refrigerating apparatus (10) that can eliminate disadvantages caused by the presence of a receiver, such as a heat loss, a const increase, and the like.

In the second and third examples, the control means judges, during the low power operation, whether the refrigerant collection operation should be performed or not. Accordingly, the amount of the refrigerant circulating in the refrigerant circuit (20) can be appropriate during the low power operation. Further, the operation states for the refrigeration cycle performed in the refrigerant circuit (20) can be set appropriately.

In the fourth example, the refrigerant flow on the one end side of the heat source side heat exchanger (33, 43, 82) in the non-operating state is limited or blocked by the corresponding flow rate adjusting mechanism (34, 44, 83), while at the same time the other end side thereof is allowed to communicate with the discharge side of the corresponding compressor (32, 42). The operation for supplying the cooling fluid to the heat source side heat exchanger (33, 43, 82) in this state is performed as the refrigerant collection operation. Accordingly, this example can ensure collection and retention of the refrigerant to and in the heat source side heat exchanger (33, 43, 82) in the non-operating state.

In the fifth example, by utilizing the fact that a correlation between excess and deficiency of the amount of the refrigerant circulating in the refrigerant circuit (20) and the high pressure of the refrigeration cycle, the amount of the refrigerant retained in the heat source side heat exchanger (33, 43, 82) in the non-operating state is adjusted based on the physical quantity serving as an index of the high pressure of the refrigeration cycle. Thus, according to the this example, the refrigerant collection operation can appropriately adjust the refrigerant amount.

In the seventh example, the control means (90) adjusts the opening of the adjusting valve (34, 44, 83) corresponding to the heat source side heat exchanger (33, 43, 82) in the non-operating state according to the degree of subcooling of the refrigerant flowing out from the heat source side heat exchanger (33, 43, 82) in the non-operating state. As described above, the degree of subcooling of the refrigerant flowing out from the heat source side heat exchanger (33, 43, 82) in the non-operating state can serve as an index indicating the amount of the refrigerant retained in the heat source side heat exchanger (33, 43, 82) in the non-operating state. Thus, according to the this example, the flow rate of the refrigerant flowing out from the heat source side heat exchanger (33, 43, 82) in the non-operating state can be adjusted according to the index indicating the amount of the refrigerant retained in the heat source side heat exchanger (33, 43, 82) in the non-operating state. As a result, the amount of the refrigerant retained in the heat source side heat exchanger (33, 43, 82) in the non-operating state can be controlled appropriately.

In the eighth example, the control means (90) adjusts the opening of the adjusting valve (34, 44, 83) corresponding to the heat source side heat exchanger (33, 43, 82) in the non-operating state according to the degree of subcooling of the refrigerant flowing out from the heat source side heat exchanger (33, 43, 82) in the operating state. As described above, the degree of subcooling of the refrigerant flowing out from the heat source side heat exchanger (33, 43, 82) in the operating state can serve as an index indicating excess or deficiency of the refrigerant circulating in the refrigerant circuit (20). Thus, according to the this example, the flow rate of the refrigerant flowing out from the heat source side heat exchanger (33, 43, 82) in the non-operating state can be adjusted according to the index indicating excess or deficiency of the refrigerant circulating in the refrigerant circuit (20). As a result, the amount of the refrigerant circulating in the refrigerant circuit (20) can be controlled appropriately.

In the ninth example, the control means (90) adjusts the opening of the heat source side expansion valve (34, 44, 83) corresponding to the heat source side heat exchanger (33, 43, 82) functioning as a condenser to keep at given values or larger the difference between the high pressure of the refrigeration cycle and the pressure of the refrigerant in the liquid side pipe (25) and the difference between the pressure of the refrigerant in the liquid side pipe (25) and the low pressure of the refrigeration cycle. Accordingly, in the state where a plurality of heat exchangers function as evaporators in the refrigerant circuit (20), the opening adjustment of the expansion valves corresponding to the heat exchangers functioning as evaporators can appropriately adjust the amounts of the refrigerant distributed to the heat exchangers. Further, in the state where a plurality of heat exchangers function as condensers in the refrigerant circuit (20), the opening adjustment of the expansion valves corresponding to the heat exchangers functioning as condensers can appropriately adjust the amounts of the refrigerant distributed to the heat exchangers.

Here, in the case where a receiver is provided at a part of the refrigerant circuit (20) communicating with the liquid side pipe (25), the receiver functions as a type of a buffer tank to cause the pressure of the refrigerant in the liquid side pipe (25) to vary slowly. For this reason, the response of the refrigerant pressure to change in opening of the expansion valves is extremely slow, thereby creating difficulty in appropriate control on the pressure of the refrigerant in the liquid side pipe (25). In contrast, in the present invention, the refrigerant collection operation can adjust the amount of the refrigerant in the refrigerant circuit (20), thereby enabling omission of such a receiver from the refrigerant circuit (20). Thus, according to the ninth example, the control means (90) performs the predetermined control operation on the heat source side expansion valves (34, 44, 83) of the refrigerant circuit (20) from which such a receiver is omitted, thereby achieving appropriate adjustment of the pressure of the refrigerant in the liquid side pipe (25).

DESCRIPTION OF CHARACTERS

20 refrigerant circuit
25 liquid side pipe
32 first compressor (compressor)
33 first outdoor heat exchanger (heat source side heat exchanger)
34 first outdoor expansion valve (flow rate adjusting mechanism, adjusting valve, heat source side expansion valve)
37 first outdoor fan (air blowing mechanism)
42 second compressor (compressor)
43 second outdoor heat exchanger (heat source side heat exchanger)
44 second outdoor expansion valve (flow rate adjusting mechanism, adjusting valve, heat source side expansion valve)
47 second outdoor fan (air blowing mechanism)
52 first indoor heat exchanger (user side heat exchanger)
53 first indoor expansion valve (user side expansion valve)
62 second indoor heat exchanger (user side heat exchanger)
63 second indoor expansion valve (user side expansion valve)
72 third indoor heat exchanger (user side heat exchanger)
73 third indoor expansion valve (user side expansion valve)
82 auxiliary outdoor heat exchanger (heat source side heat exchanger)
83 auxiliary outdoor expansion valve (flow rate adjusting mechanism, adjusting valve, heat source side expansion valve)
82 auxiliary outdoor fan (air blowing mechanism)
90 controller (control means)
131 first high pressure sensor (high pressure detecting means)
141 second high pressure sensor (high pressure detecting means)

DETAIL DESCRIPTION OF THE INVENTION

Best Mode for Carrying Out the Invention

Example embodiments of the present invention will be described below in detail with reference to the accompanying drawings.

Example Embodiment 1

Example Embodiment 1 of the present invention will now be described. The present example embodiment is directed to an air conditioner (10) configured by a refrigerating apparatus according to the present invention.

Figure 1:
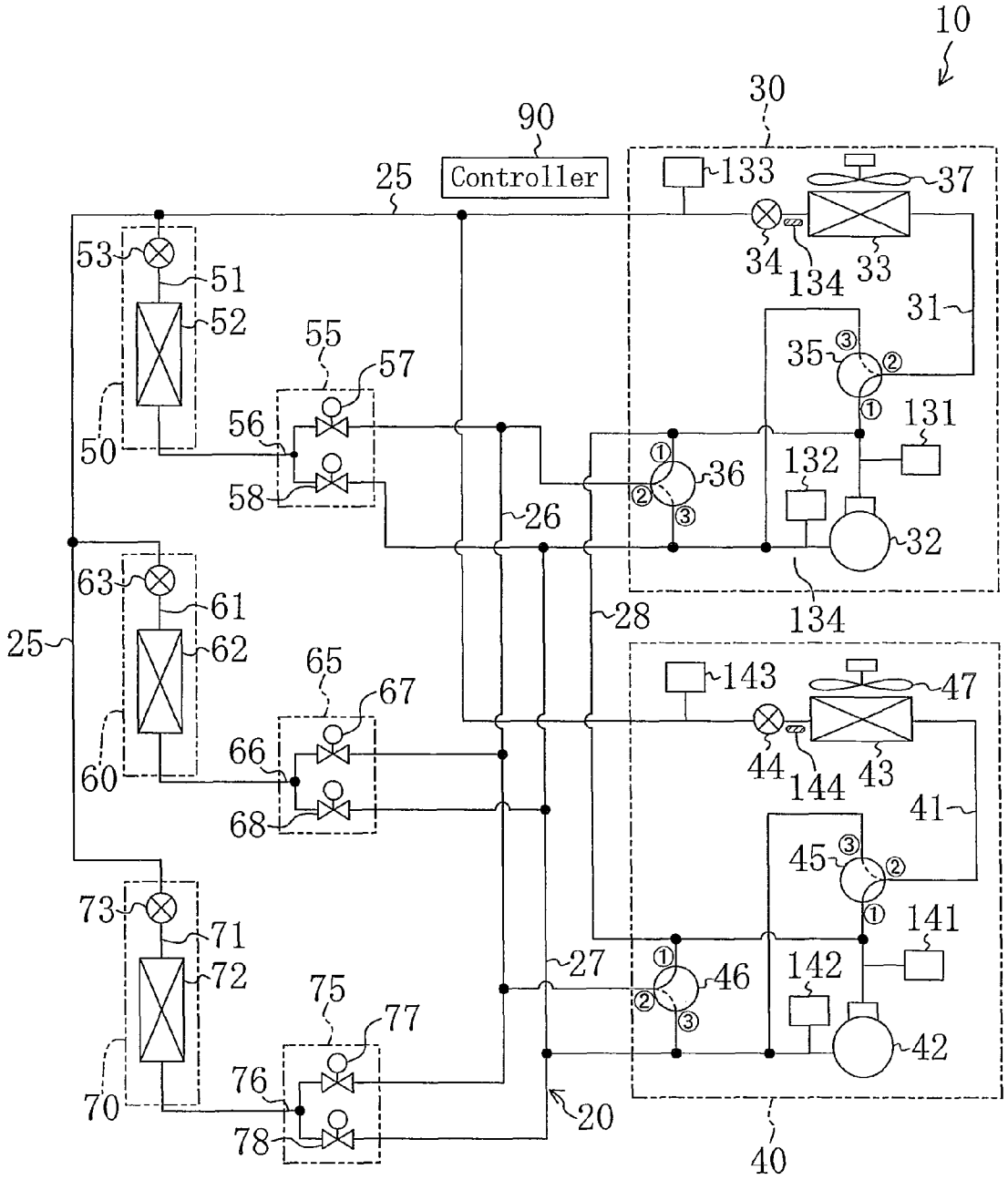
FIG. 1 is a refrigerant circuit diagram showing a configuration of a refrigerant circuit according to Example Embodiment 1.

As shown in FIG. 1, the air conditioner (10) according to the present example embodiment includes two outdoor units (30, 40), three indoor units (50, 60, 70), three switching units (55, 65, 75), and a controller (90). In this air conditioner (10), a refrigerant circuit (20) is formed by connecting the outdoor units (30, 40), the indoor units (50, 60, 70), and the switching units (55, 65, 75) through a high pressure gas side pipe (26), a low pressure gas side pipe (27), and a connection pipe (28).

The first outdoor unit (30) and the second outdoor unit (40) house a first outdoor circuit (31) and a second outdoor circuit (41), respectively. The outdoor circuits (31, 41) have the same configuration.

Specifically, the outdoor circuits (31, 41) include compressors (32, 42), outdoor heat exchangers (33, 43) as heat source side heat exchangers, outdoor expansion valves (34, 44) as heat source side expansion valves, main three-way switching valves (35, 45), and sub three-way switching valves (36, 46). In the outdoor circuits (31, 41), the discharge sides of the compressors (32, 42) are connected to the first ports of the main three-way switching valves (35, 45) and the first ports of the sub three-way switching valves (36, 46). The suction sides of the compressors (32, 42) are connected to the third ports of the main three-way switching valves (35, 45) and the third ports of the sub three-way switching valves (36, 46). The outdoor heat exchangers (33, 43) are connected at their one ends to the second ports of the main three-way switching valves (35, 45) while being connected at their other ends to respective one ends of the outdoor expansion valves (34, 44). The outdoor expansion valves (34, 44) serve as flow rate adjusting mechanisms configured to limit or block the refrigerant flow on the other end sides of the corresponding outdoor heat exchangers (33, 43). The outdoor expansion valves (34, 44) also serve as opening variable adjusting valves.

In the outdoor circuits (31, 41), high pressure sensors (131, 141) and low pressure sensors (132, 142) are connected to the discharge sides and suction sides of the compressors (32, 42), respectively, and liquid pressure sensors (133, 143) are connected to the other sides of the outdoor expansion valves (34, 44). Further, the outdoor circuits (31, 41) include refrigerant temperature sensors (134, 144).

The high pressure sensors (131, 141) are pressure sensors configured to detect the pressures of the refrigerant discharged from the compressors (32, 42). The discharge pressures of the compressors (32, 42) that the high pressure sensors (131, 141) detect are physical quantities serving as indices indicating the high pressure of the refrigeration cycle. Accordingly, the high pressure sensors (131, 141) serve as high pressure detecting means configured to detect physical quantities serving as indices indicating the high pressure of the refrigeration cycle.

The low pressure sensors (132, 142) are pressure sensors configured to detect the pressures of the refrigerant sucked to the compressors (32, 42). The suction pressures of the compressors (32, 42) that the low pressure sensors (132, 142) detect are physical quantities serving as indices indicating the low pressure of the refrigeration cycle. Accordingly, the low pressure sensors (132, 142) serve as low pressure detecting means configured to detect physical quantities serving as indices indicating the low pressure of the refrigeration cycle.

The liquid pressure sensors (133, 143) are pressure sensors configured to detect the pressures of the refrigerant flowing in the liquid side pipe (25). The refrigerant pressures that the liquid pressure sensors (133, 143) detect are physical quantities serving as indices indicating the pressures of the refrigerant flowing in the liquid side pipe (25). Accordingly, the liquid pressure sensors (133, 143) serve as liquid pressure detecting means configured to detect physical quantities serving as indices indicating the pressure of the refrigerant flowing in the liquid side pipe (25).

The refrigerant temperature sensors (134, 144) are thermistors attached to the refrigerant pipes. The first refrigerant temperature sensor (134) is disposed in the vicinity of the end portion of the first outdoor heat exchanger (33) on the side of the first outdoor expansion valve (34). The second refrigerant temperature sensor (144) is disposed in the vicinity of the end portion of the second outdoor heat exchanger (43) on the side of the second outdoor expansion valve (44). The refrigerant temperature sensors (134, 144) detect the temperatures of the refrigerant flowing in the refrigerant pipes.

The first indoor unit (50), the second indoor unit (60), and the third indoor unit (70) house a first indoor circuit (51), a second indoor circuit (61), and a third indoor circuit (71), respectively. The indoor circuits (51, 61, 71) have the same configuration.

Specifically, the indoor circuits (51, 61, 71) include indoor heat exchangers (52, 62, 72) and indoor expansion valves (53, 63, 73). In the indoor circuits (51, 61, 71), the indoor heat exchangers (52, 62, 72) are connected in series to the indoor expansion valves (53, 63, 73).

The first switching unit (55), the second switching unit (65), and the third switching unit (75) house a first switching circuit (56), a second switching circuit (66), and a third switching circuit (76), respectively. The switching circuits (56, 66, 76) have the same configuration.

Specifically, the switching circuits (56, 66, 76) include high pressure side solenoid valves (57, 67, 77) and low pressure side solenoid valves (58, 68, 78). The switching circuits (56, 66, 76) have respective one ends branching into two. The high pressure side solenoid valves (57, 66, 76) are connected to respective ones of the branch pipes, while the low pressure side solenoid valves (58, 68, 78) are connected to the other branch pipes.

The liquid side pipe (25) has one end branching into two and the other end branching into three. On the one end side of the liquid side pipe (25), the first branch pipe is connected to the first outdoor expansion valve (34) of the first outdoor circuit (31), and the second branch pipe is connected to the second outdoor expansion valve (44) of the second outdoor circuit (41). On the other end side of the liquid side pipe (25), the first branch pipe, the second branch pipe, and the third branch pipe are connected to the first indoor expansion valve (53) of the first indoor circuit (51), the second indoor expansion valve (63) of the second indoor circuit (61), and the third indoor expansion valve (73) of the third indoor circuit (71), respectively.

The high pressure gas side pipe (26) has one end branching into two and the other end branching into three. On the one end side of the high pressure gas side pipe (26), the first branch pipe is connected to the second port of the first sub three-way switching valve (36) provided in the first outdoor circuit (31), and the second branch is connected to the second port of the second sub three-way switching valve (46) provided in the second outdoor circuit (41). On the other hand, on the other end side of the high pressure gas side pipe (26), the first branch pipe, the second branch pipe, and the third branch pipe are connected to the first high pressure side solenoid valve (57) of the first switching circuit (56), the second high pressure side solenoid valve (67) of the second switching circuit (66), and the third high pressure side solenoid valve (77) of the third switching circuit (76), respectively.

The low pressure gas side pipe (27) has one end branching into two and the other end branching into three. On the one end side of the low pressure gas side pipe (27), the first branch pipe is connected to the suction side of the first compressor (32) provided in the first outdoor circuit (31), and the second branch is connected to the suction side of the second compressor (42) provided in the second outdoor circuit (41). On the other hand, on the other end side of the low pressure gas side pipe (27), the first branch pipe, the second branch pipe, and the third branch pipe are connected to the first low pressure side solenoid valve (58) of the first switching circuit (56), the second low pressure side solenoid valve (68) of the second switching circuit (66), and the third low pressure side solenoid valve (78) of the third switching circuit (76), respectively.

The connection pipe (28) is connected at one end thereof to the discharge side of the first compressor (32) of the first outdoor circuit (31), while being connected at the other end thereof to the discharge side of the second compressor (42) of the second outdoor circuit (41).

Further, in the refrigerant circuit (20), the first indoor heat exchanger (52) of the first indoor circuit (51), the second indoor heat exchanger (62) of the second indoor circuit (61), and the third indoor heat exchanger (72) of the third indoor circuit (71) are connected to the first switching circuit (56) of the first switching unit (55), the second switching circuit (66) of the second switching unit (65), and the third switching circuit (76) of the third switching unit (75), respectively.

The outdoor heat exchangers (33, 43) and the indoor heat exchangers (52, 62, 72) are configured by fin and tube heat exchangers of cross fin type. The outdoor units (30, 40) include outdoor fans (37, 47) for supplying outdoor air to the outdoor heat exchangers (33, 43). The outdoor heat exchangers (33, 43) heat exchange the outdoor air supplied from the outdoor fans (37, 47) with the refrigerant. The outdoor fans (37, 47) serve as air blowing mechanisms for supplying outdoor air to the outdoor heat exchangers (33, 43).

Though not shown, the indoor units (50, 60, 70) include indoor fans for supplying indoor air to the indoor heat exchangers (52, 62, 72). The indoor heat exchangers (52, 62, 72) heat exchange the indoor air supplied from the indoor fans with the refrigerant.

The main three-way switching valves (35, 45) and the sub three-way switching valves (36, 46) are switched between a first state indicated by the solid lines in FIG. 1 and a second state indicated by broken lines in FIG. 1. In the first state, the second ports communicate with only the first ports while being cut off from the third ports. In the second state, the second ports communicate with only the third ports while being cut off from the first ports.

Figure 2:
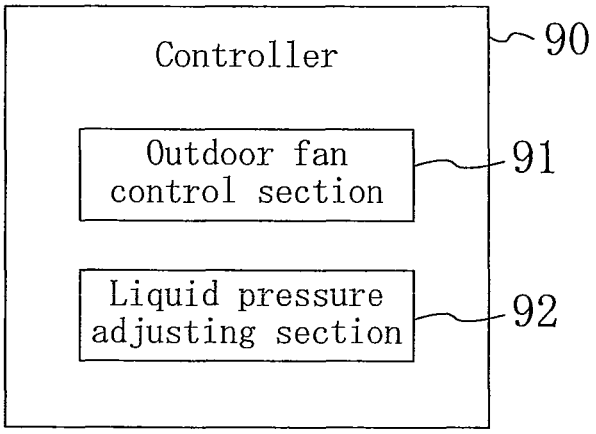
FIG. 2 is a block diagram showing a configuration of a controller in Example Embodiment 1.

As shown in FIG. 2, the controller (90) includes an outdoor fan control section (91) and a liquid pressure adjusting portion (92). The controller (90) serves as control means. The outdoor fan control section (91) is configured to control the rotation speed of the outdoor fan (37, 47) provided in an outdoor unit (30, 40) in a non-operating state on the basis of the detected value of the pressure sensor (131, 141) provided in an outdoor unit (30, 40) in an operating state. The liquid pressure adjusting section (92) is configured to individually control the openings of the outdoor expansion valves (34, 44) on the basis of the detection values of the high pressure sensors (131, 141), the low pressure sensors (132, 142), and the liquid pressure sensors (133, 143) of the outdoor units (30, 40) in which the respective outdoor expansion valves (34, 44) are provided.

Incidentally, in general refrigerant circuits, receivers for adjusting the amount of the refrigerant are provided at parts where the high-pressure liquid refrigerant flows. Further, in general refrigerant circuits, accumulators for gas/liquid separation are provided on the suction sides of the compressors in some cases. The accumulators may be utilized for adjusting the amount of the refrigerant. In contrast, the refrigerant circuit (20) in the present example embodiment includes neither such a receiver nor such an accumulator. In other words, both a receiver and an accumulator are omitted from the refrigerant circuit (20). It is noted that the refrigerant circuit (20) in the present example embodiment may include an accumulator with a receiver omitted.

—Operation Mode—

In the air conditioner (10) of the present example embodiment, the operation of the outdoor units (30, 40) and the indoor units (50, 60, 70) can be set individually. In particular, in the air conditioner (10), cooling and heating of the three indoor units (50, 60, 70) can be set individually. Accordingly, the air conditioner (10) can perform various operation modes. The air conditioner (10) is capable of performing refrigerant collection operation in an operation mode where one of the outdoor units (30, 40) is stopped. Here, some typical operation modes and the refrigerant collection operation will be described of the operation modes that the air conditioner (10) can perform.

<Cooling Operation>

Figure 3:
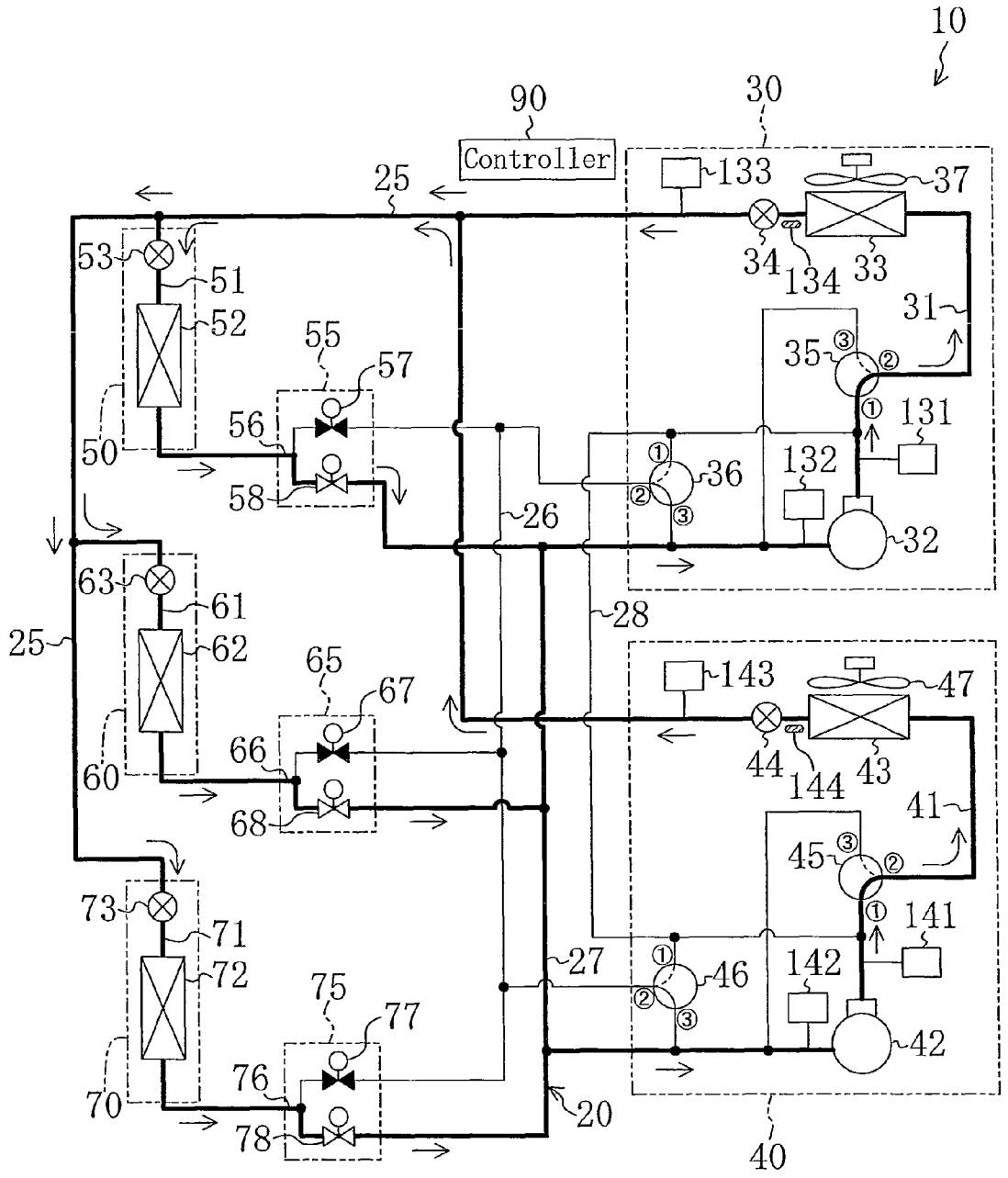
FIG. 3 is a refrigerant circuit diagram showing operation of an air conditioner in cooling operation according to Example Embodiment 1.

Cooling operation will be described in which all the indoor units (50, 60, 70) in operation perform cooling. Here, description will be given with reference to FIG. 3 to the case where all the outdoor units (30, 40) and all the indoor units (50, 60, 70) are operated.

In the outdoor units (30, 40), the main three-way switching valves (35, 45) and the sub three-way switching valves (36, 46) are set to the first state and the second state, respectively, and the outdoor expansion valves (34, 44) are opened fully. In the indoor units (50, 60, 70), the openings of the indoor expansion valves (53, 63, 73) are controlled. The opening control is performed individually on the indoor expansion valves (53, 63, 73) so that the degrees of superheat of the refrigerant at the outlets of the indoor heat exchangers (52, 62, 72) corresponding to the indoor expansion valves (53, 63, 73) become predetermined target values. In the switching units (55, 65, 75), the high pressure side solenoid valves (57, 67, 77) are closed, and the low pressure side solenoid valves (58, 68, 78) are opened.

In the outdoor circuits (31, 41), the refrigerant discharged from the compressors (32, 42) dissipate heat to outdoor air in the outdoor heat exchangers (33, 43) to be condensed, passes through the outdoor expansion valves (34, 44), and then flows into the liquid side pipe (25). The refrigerant flowing in the liquid side pipe (25) from the outdoor circuits (31, 41) is distributed to the three indoor circuits (51, 61, 71). In the indoor circuits (51, 61, 71), the refrigerant flowing therein is reduced in pressure when passing through the indoor expansion valves (53, 63, 73), and then absorbs heat from indoor air in the indoor heat exchangers (52, 62, 72) to be evaporated. The indoor units (50, 60, 70) supply the air cooled in the indoor heat exchangers (52, 62, 72) indoors. The refrigerant flowing out from the indoor circuits (51, 61, 71) passes through the low pressure side solenoid valves (58, 68, 78) of the corresponding switching circuits (56, 66, 76), and then flows into the low pressure gas side pipe (27). The refrigerant flowing in the low pressure gas side pipe (27) is distributed to the two outdoor circuits (31, 41), and is sucked into the compressors (32, 42) of the outdoor circuits (31, 41) to be compressed.

<Heating Operation>

Figure 4:
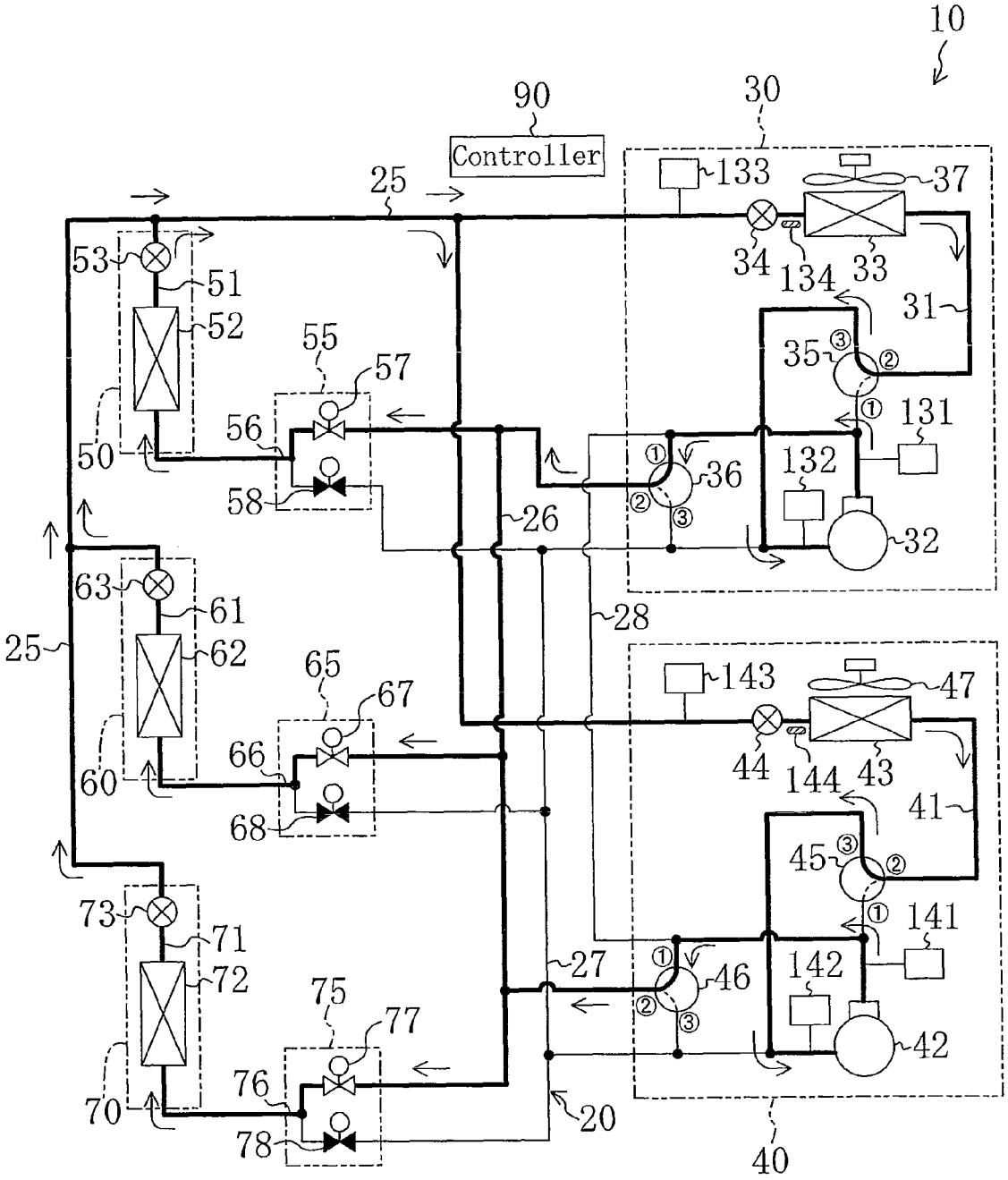
FIG. 4 is a refrigerant circuit diagram showing operation of the air conditioner in heating operation according to Example Embodiment 1.

Heating operation will be described in which all the indoor units (50, 60, 70) in operation perform heating. Here, description will be given with reference to FIG. 4 to the case where all the outdoor units (30, 40) and all the indoor units (50, 60, 70) are operated.

In the outdoor units (30, 40), the main three-way switching valves (35, 45) and the sub three-way switching valves (36, 46) are set to the second state and the first state, respectively, and the openings of the outdoor expansion valves (34, 44) are controlled. The opening control is performed individually on the outdoor expansion valves (34, 44) so that the degrees of superheat of the refrigerant at the outlets of the outdoor heat exchangers (34, 44) corresponding to the outdoor expansion valves (34, 44) become predetermined target values. In the indoor units (50, 60, 70), the openings of the indoor expansion valves (53, 63, 73) are controlled. The opening control is performed individually on the indoor expansion valves (53, 63, 73) so that the degrees of subcooling of the refrigerant at the outlets of the indoor heat exchangers (52, 62, 72) corresponding to the indoor expansion valves (53, 63, 73) become constant. In the switching units (55, 65, 75), the high pressure side solenoid valves (57, 67, 77) are opened, and the low pressure side solenoid valves (58, 68, 78) are closed.

In the outdoor circuits (31, 41), the refrigerant discharged from the compressors (32, 42) passes through the sub three-way switching valves (36, 46), and then flows into the high pressure gas side pipe (26). The refrigerant flowing in the high pressure gas side pipe (26) from the outdoor circuits (31, 41) is distributed to the three switching circuits (56, 66, 76). The refrigerant flowing in the switching circuits (56, 66, 76) passes through the high pressure side solenoid valves (57, 67, 77), and then flows into the corresponding indoor circuits (51, 61, 71). In the indoor circuits (51, 61, 71), the refrigerant flowing therein dissipates heat to indoor air in the indoor heat exchangers (52, 62, 72) to be condensed, and then passes through the indoor expansion valves (53, 63, 73). The indoor units (50, 60, 70) supply the air heated in the indoor heat exchangers (52, 62, 72) indoors. The refrigerant flowing out from the indoor circuits (51, 61, 71) goes through the liquid side pipe (25), and then is distributed to the two outdoor circuits (31, 41). In the outdoor circuits (31, 41), the refrigerant flowing therein is reduced in pressure when passing through the outdoor expansion valves (34, 44), absorbs heat from outdoor air in the outdoor heat exchangers (33, 44) to be evaporated, passes through the main three-way switching valves (35, 45), and then is sucked into the compressors (32, 42) to be compressed.

<First Cooling/Heating Operation>

First cooling/heating operation where some of the indoor units perform(s) cooling while the other indoor unit(s) perform(s) heating will be described next. In this first cooling/heating operation, the outdoor heat exchangers (33, 43) of the outdoor units (30, 40) function as condensers. Here, the case will be described with reference to FIG. 5 where the first indoor unit (50) performs heating while the second indoor unit (60) and the third indoor unit (70) perform cooling, and the first outdoor unit (30) is in an operating state while the second outdoor unit (40) is in a non-operating state.

In the outdoor units (30, 40), the main three-way switching valves (35, 45) and the sub three-way switching valves (36, 46) are set to the first state and the second state, respectively. In the first outdoor unit (30), the first outdoor expansion valve (34) is opened fully. In the second outdoor unit (40), the second outdoor expansion valve (44) is closed fully. In the indoor units (50, 60, 70), the openings of the indoor expansion valves (53, 63, 73) are controlled. In the first indoor unit (50) performing heating, the opening of the first indoor expansion valve (53) is controlled so that the degree of subcooling of the refrigerant at the outlet of the first indoor heat exchanger (52) is a predetermined target value. In the second and third indoor units (60, 70) performing cooling, the openings of the indoor expansion valves (63, 73) are controlled individually so that the degrees of superheat at the outlets of the indoor heat exchangers (62, 72) are predetermined target values. In the first switching unit (55), the first high pressure side solenoid valve (57) is opened, and the first low pressure side solenoid valve (58) is closed. In the second and third switching units (65, 75), the high pressure side solenoid valves (67, 77) are closed, and the low pressure side solenoid valves (58, 68) are opened.

In the first outdoor circuit (31), part of the refrigerant discharged from the first compressor (32) flows into the first outdoor heat exchanger (33), while the other part of the refrigerant flows into the high pressure gas side pipe (26) via the first sub three-way switching valve (36). The refrigerant flowing in the first outdoor heat exchanger (33) dissipates heat to outdoor air to be condensed, passes through the outdoor expansion valve (34), and then flows into the liquid side pipe (25). The refrigerant flowing in the high pressure gas side pipe (26) passes through the first high pressure side solenoid valve (57) of the first switching circuit (56), and then flows into the first indoor circuit (51). The refrigerant flowing in the first indoor circuit (51) dissipates heat to indoor air in the first indoor heat exchanger (52) to be condensed, passes through the first indoor expansion valve (53), and then flows into the liquid side pipe (25) to be merged with the refrigerant condensed in the first outdoor heat exchanger (33). The first indoor unit (50) supplies the air heated in the first indoor heat exchanger (52) indoors.

The refrigerant flowing in the liquid side pipe (25) is distributed to the second indoor unit (60) and the third indoor unit (70). In the second indoor unit (60) and the third indoor unit (70), the refrigerant flowing therein is reduced in pressure when passing through the indoor expansion valves (63, 73), absorbs heat from indoor air in the indoor heat exchangers (62, 72) to be evaporated, passes through the low pressure side solenoid valves (68, 78) of the corresponding switching circuits (66, 76), and then flows into the low pressure gas side pipe (27). The refrigerant flowing in the low pressure gas side pipe (27) flows into the first outdoor circuit (31), and then is sucked into the first compressor (32) to be compressed. The second indoor unit (60) and the third indoor unit (70) supply the air cooled in the indoor heat exchangers (62, 72) indoors.

During this first cooling/heating operation, the liquid pressure adjusting section (92) of the controller (90) controls the opening of the first outdoor expansion valve (34). The liquid pressure adjusting section (92) receives the detected value of the first high pressure sensor (131), the detected value of the first low pressure sensor (132), and the detected value of the first liquid pressure sensor (133). The liquid pressure adjusting section (92) adjusts the opening of the first outdoor expansion valve (34) so that the difference between the detected value of the first high pressure sensor (131) and the detected value of the first liquid pressure sensor (133) (i.e., the difference between the pressure of the refrigerant discharged from the first compressor (32) and that of the refrigerant flowing in the liquid side pipe (25)) becomes equal to or larger than a predetermined first reference value and the difference between the detected value of the first liquid pressure sensor (133) and the detected value of the first low pressure sensor (132) (i.e., the difference between the pressure of the refrigerant flowing in the liquid side pipe (25) and that of the refrigerant sucked to the first compressor (32)) becomes equal to or larger than a predetermined second reference value.

Figure 5:
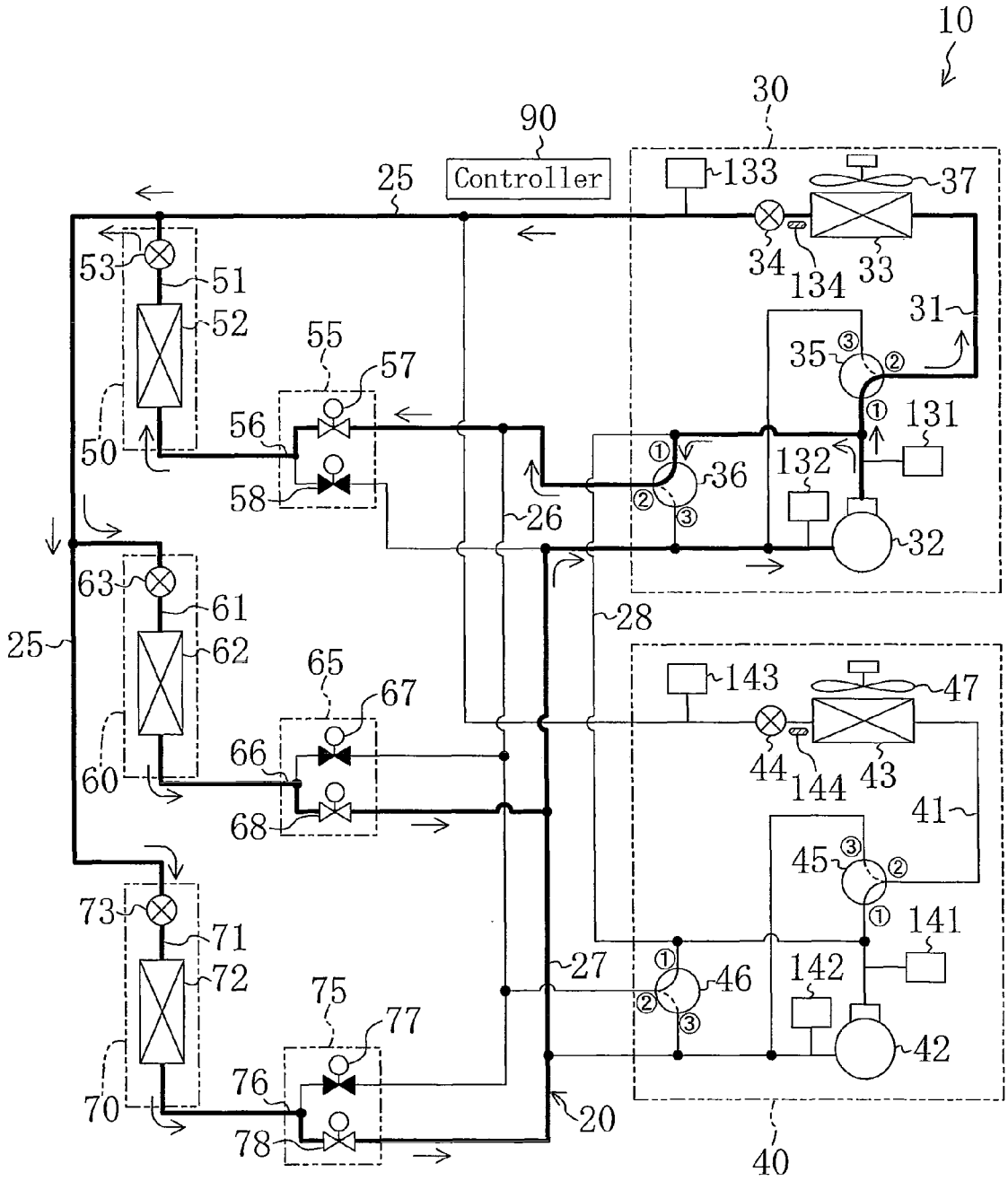
FIG. 5 is a refrigerant circuit diagram showing operation of the air conditioner in first cooling/heating operation according to Example Embodiment 1.

During the first cooling/heating operation shown in FIG. 5, the first outdoor heat exchanger (33) and the first indoor heat exchanger (52) function as condensers. Accordingly, the ratio between the amount of the refrigerant flowing to the first outdoor heat exchanger (33) and that of the refrigerant flowing in the first indoor heat exchanger (52) of the refrigerant discharged from the compressor (i.e., a refrigerant distribution ratio between the first outdoor heat exchanger (33) and the first indoor heat exchanger (52)) must be set appropriately. To do so, the flow rate of the refrigerant passing through the first outdoor expansion value (34) and that of the refrigerant passing through the first indoor expansion valve (53) must be set appropriately.

However, if the pressure differences between the respective sides of the first outdoor expansion valve (34) and between those of the first indoor expansion valve (53) are too small, change in openings of the first outdoor expansion valve (34) and the first indoor expansion valve (53) can hardly change the flow rates of the refrigerant passing therethrough.

In view of this, in the present example embodiment, the liquid pressure adjusting section (92) adjusts the opening of the first outdoor expansion valve (34) during the first cooling/heating operation to keep at the predetermined first predetermined reference value or larger the difference between the pressure of the refrigerant discharged from the first compressor (32) and that of the refrigerant flowing in the liquid side pipe (25), that is, the pressure differences between the respective sides of the first outdoor expansion valve (34) and between those of the first indoor expansion valve (53). Thus, adjusting the first outdoor expansion valve (34) and the first indoor expansion valve (53) can result in appropriate setting of the refrigerant distribution ratio between the first outdoor heat exchanger (33) and the first indoor heat exchanger (52) during the first cooling/heating operation.

Further, during the first cooling/heating operation shown in FIG. 5, the second indoor heat exchanger (62) and the third indoor heat exchanger (72) function as evaporators. Accordingly, the ratio between the amount of the refrigerant flowing to the second indoor heat exchanger (62) and that of the refrigerant flowing in the third indoor heat exchanger (72) of the refrigerant flowing in the liquid side pipe (25) (i.e., a refrigerant distribution ratio between the second indoor heat exchanger (62) and the third indoor heat exchanger (72)) must be set appropriately. To do so, the flow rate of the refrigerant passing through the second indoor expansion value (63) and that of the refrigerant passing through the third indoor expansion valve (73) must be set appropriately.

However, if the pressure differences between the respective sides of the second indoor expansion valve (63) and between those of the third indoor expansion valve (73) are too small, change in openings of the second indoor expansion valve (63) and the third indoor expansion valve (73) can hardly change the flow rates of the refrigerant passing therethrough.

In view of this, in the present example embodiment, the liquid pressure adjusting section (92) adjusts the opening of the first outdoor expansion valve (34) during the first cooling/heating operation to keep at the predetermined second reference value or larger the difference between the pressure of the refrigerant flowing in the liquid side pipe (25) and that of the refrigerant sucked to the first compressor (32), that is, the pressure differences between the respective sides of the second indoor expansion valve (63) and between those of the third indoor expansion valve (73). Thus, adjusting the second indoor expansion valve (63) and the third indoor expansion valve (73) can result in appropriate setting of the refrigerant distribution ratio between the second indoor heat exchanger (62) and the third indoor heat exchanger (72) during the first cooling/heating operation.

<Second Cooling/Heating Operation>

Second cooling/heating operation where some of the indoor units perform(s) cooling while the other indoor unit(s) perform(s) heating will be described next. In this second cooling/heating operation, the outdoor heat exchangers (33, 43) of the outdoor units (30, 40) function as evaporators. Here, the case will be described with reference to FIG. 6 where the first indoor unit (50) performs cooling while the second indoor unit (60) and the third indoor unit (70) perform heating, and the first outdoor unit (30) is in the operating state while the second outdoor unit (40) is in the non-operating state.

In the outdoor units (30, 40), the main three-way switching valves (35, 45) and the sub three-way switching valves (36, 46) are set to the second state and the first state, respectively. In the first outdoor unit (30), the opening of the first outdoor expansion valve (34) is controlled appropriately. In the second outdoor unit (40), the second outdoor expansion valve (44) is closed fully. The opening of the first outdoor expansion valve (34) is controlled so that the degree of superheat of the refrigerant at the outlet of the first outdoor heat exchanger (33) is a predetermined target value. In the indoor units (50, 60, 70), the openings of the indoor expansion valves (53, 63, 73) are controlled. In the first indoor unit (50) performing cooling, the opening of the first indoor expansion valve (53) is controlled so that the degree of superheat of the refrigerant at the outlet of the first indoor heat exchanger (52) is a predetermined target value. In the second and third indoor units (60, 70) performing heating, the openings of the indoor expansion valves (63, 73) are controlled individually so that the degrees of subcooling at the outlets of the indoor heat exchangers (62, 72) are predetermined target values. In the first switching unit (55), the first high pressure side solenoid valve (57) is closed, and the first low pressure side solenoid valve (58) is opened. In the second and third switching units (65, 75), the high pressure side solenoid valves (67, 77) are opened, and the low pressure side solenoid valves (58, 68) are closed.

In the first outdoor circuit (31), the refrigerant discharged from the first compressor (32) flows into the high pressure gas side pipe (26) via the first sub three-way switching valve (36). Part of the refrigerant flowing in the high pressure gas side pipe (26) passes through the second high pressure side solenoid valve (67) of the second switching circuit (66), and then flows into the second indoor unit (60). The other part of the refrigerant passes through the third high pressure side solenoid valve (77) of the third switching circuit (76), and then flows into the third indoor unit (70). In the second indoor unit (60) and the third indoor unit (70), the refrigerant flowing in the indoor circuits (61, 71) dissipates heat to indoor air in the indoor heat exchangers (62, 72) to be condensed, passes through the indoor expansion valves (63, 73), and then flows into the liquid side pipe (25). The second indoor unit (60) and the third indoor unit (70) supply the air heated in the indoor heat exchangers (62, 72) indoors.

The refrigerant flowing in the liquid side pipe (25) is distributed to the first indoor circuit (51) and the first outdoor circuit (31). The refrigerant flowing in the first indoor circuit (51) is reduced in pressure when passing through the first indoor expansion valve (53), and then absorbs heat from indoor air in the first indoor heat exchanger (52) to be evaporated. The refrigerant evaporated in the first indoor heat exchanger (52) passes through the first low pressure side solenoid valve (58) of the first switching circuit (56), and then flows into the low pressure gas side pipe (27). The first indoor unit (50) supplies the air cooled in the first indoor heat exchanger (52) indoors. The refrigerant flowing in the first outdoor circuit (31) is reduced in pressure when passing through the first outdoor expansion valve (34), and then absorbs heat from outdoor air in the first outdoor heat exchanger (33) to be evaporated. The refrigerant evaporated in the first outdoor heat exchanger (33) is sucked into the compressor together with the refrigerant flowing from the low pressure gas side pipe (27) to be compressed.

<Refrigerant Collection Operation>

In the air conditioner (10) in either the cooling operation or in the heating operation, some of the three indoor units (50, 60, 70) may be in a non-operating state. In this case, in the indoor unit (50, 60, 70) in the non-operating state, the corresponding indoor expansion valve (53, 63, 73) is closed fully to block the refrigerant flow to the corresponding indoor heat exchanger (52, 62, 72).

Figure 6:
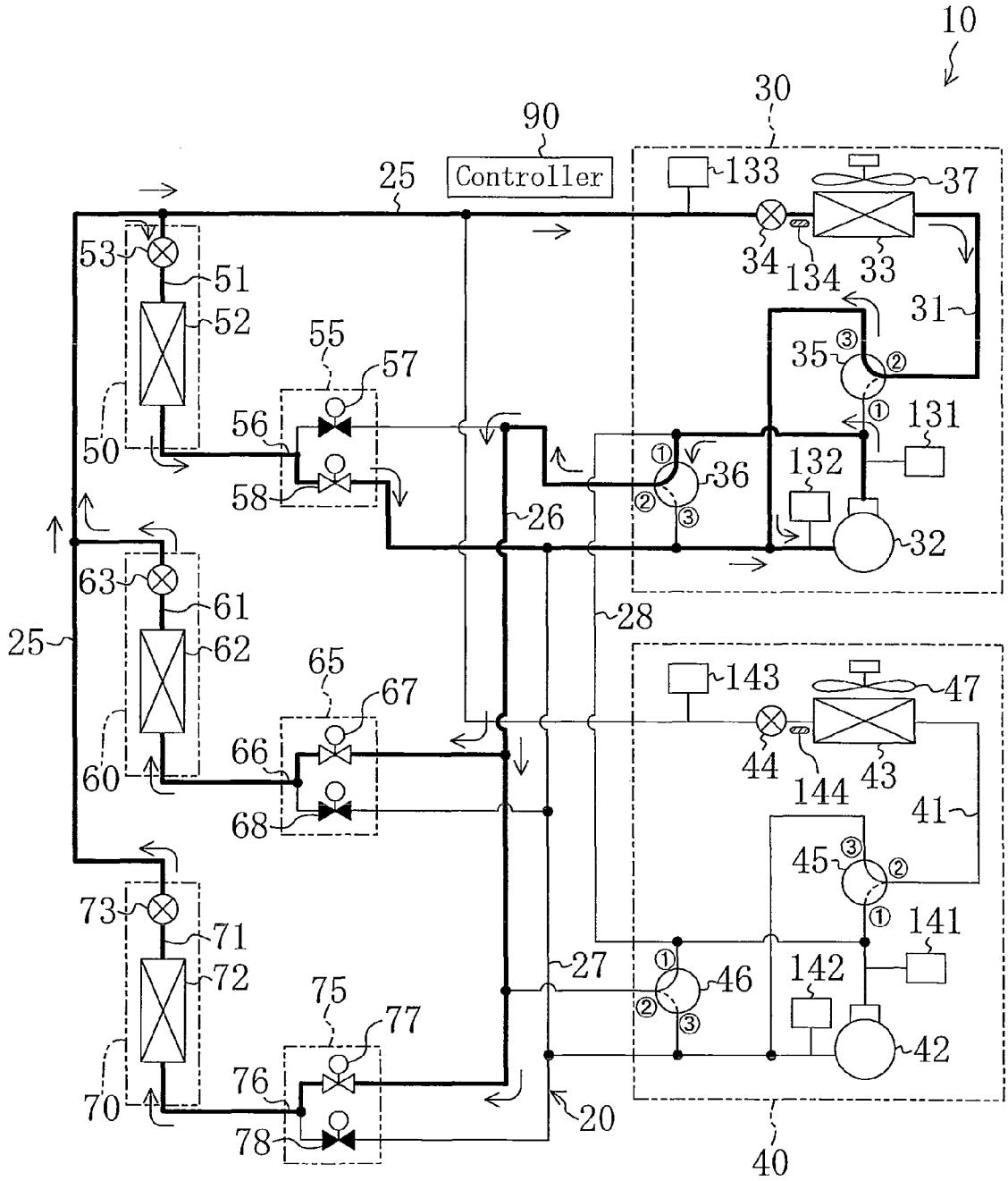
FIG. 6 is a refrigerant circuit diagram showing operation of the air conditioner in second cooling/heating operation according to Example Embodiment 1.

In such an operation state where some of the indoor units (50, 60, 70) is in the non-operating state, one of the outdoor units (30, 40) may be in a non-operating state. Alternatively, as shown in FIGS. 5 and 6, one of the outdoor units (30, 40) may be in the non-operating state in the air conditioner (10) even in any cooling/heating operation. In an outdoor unit (30, 40) in the non-operating state, the corresponding compressor (32, 42) is a non-operating state, and the corresponding outdoor heat exchanger (33, 43) is in an non-operating state where the refrigerant does not pass therethrough. The air conditioner (10) in the present example embodiment performs, as low power operation, an operation mode where the refrigeration cycle is performed by operating only one of the outdoor units.

In air conditioners, like the air conditioner (10) according to the present example embodiment including a plurality of outdoor units (30, 40) and a plurality of indoor units (50, 60, 70), the refrigerant is filled in the refrigerant circuit (20) to the amount that the refrigeration cycle can be performed stably even when all the units are operated. For this reason, in the low power operation where one of the outdoor units (30, 40) is stopped, the amount of the refrigerant in the refrigerant circuit (20) may be excessive. In such a case, the air conditioner (10) of the present example embodiment performs refrigerant collection operation to collect and retain surplus refrigerant to and in the outdoor heat exchanger (33, 43) in the non-operating state.

The air conditioner (10) of the present example embodiment can perform first refrigerant collection operation where the compressor (32, 42) of an outdoor unit (30, 40) in the non-operating state is stopped, and second refrigerant collection operation where the compressor (32, 42) of an outdoor unit (30, 40) in the non-operating state is operated. Here, the refrigerant collection operation will be described by referring to the example where the second outdoor unit (40) and the third indoor unit (70) are stopped in the cooling operation.

The first refrigerant collection operation will now be described with reference to FIG. 7. In the second outdoor unit (40) in the non-operating state, the second compressor (42) is stopped, and the second main three-way switching valve (45) and the second sub three-way switching valve (46) are set to the first state and the second state, respectively. Further, the second outdoor expansion valve (44) is closed fully. In this state, in the second outdoor unit (40), the second outdoor fan (47) is operated to supply outdoor air as a cooling fluid to the second outdoor heat exchanger (43).

Figure 7:
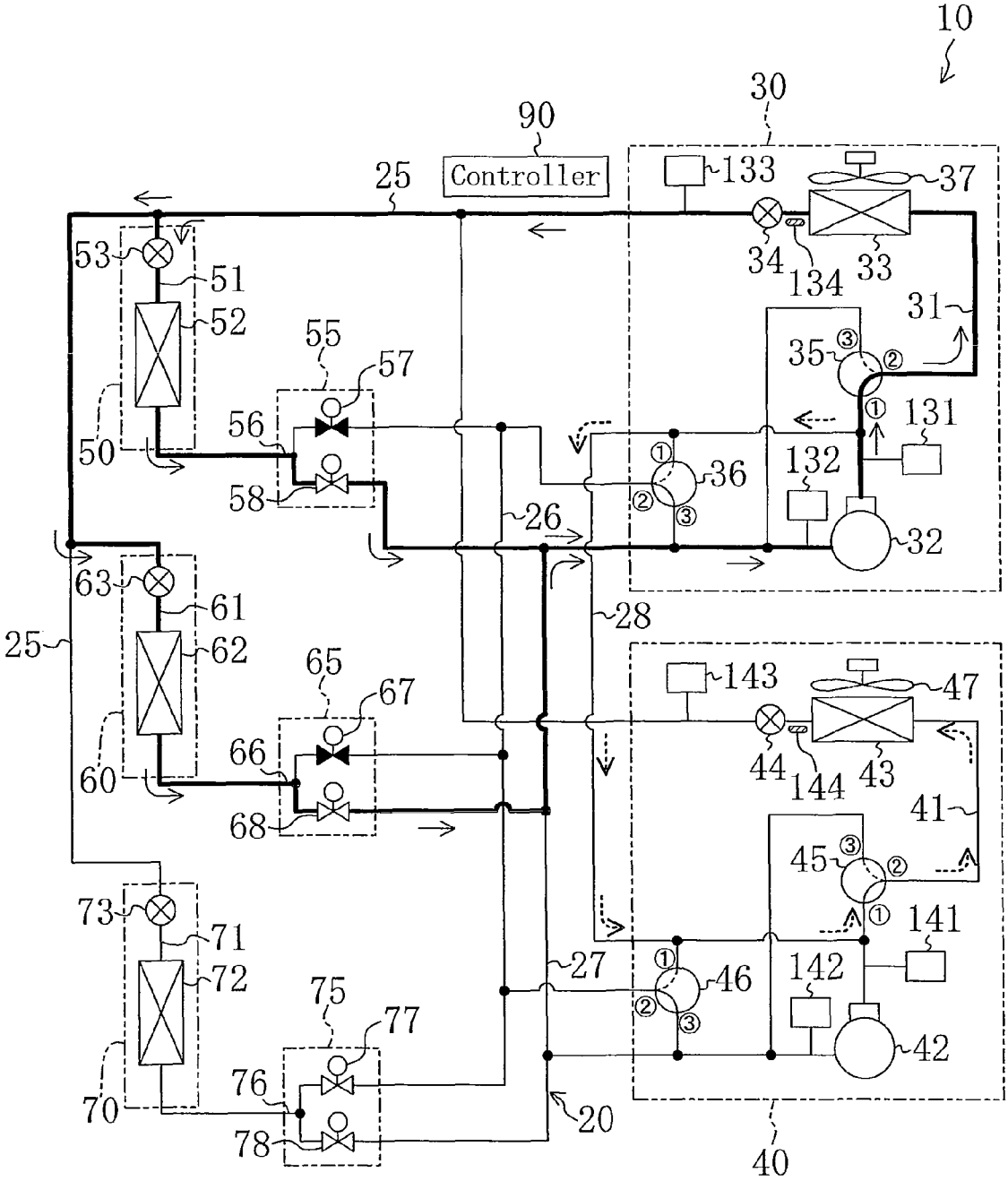
FIG. 7 is a refrigerant circuit diagram showing operation of the air conditioner in first refrigerant collection operation according to Example Embodiment 1.

In the refrigerant circuit (20) during the first refrigerant collection operation, part of the refrigerant discharged from the first compressor (32) flows as indicated by broken arrows in FIG. 7. Specifically, part of the refrigerant discharged from the first compressor (32) flows into the second outdoor circuit (41) through the connection pipe (28), and passes through the second main three-way switching valve (45), and then flows into the second outdoor heat exchanger (43). In the second outdoor heat exchanger (43), the refrigerant flowing therein is cooled by the outdoor air supplied by the second outdoor fan (47) to be condensed. Since the second outdoor expansion valve (44) is closed fully, the refrigerant condensed in the second outdoor heat exchanger (43) remains retained in the second outdoor heat exchanger (43).

The second refrigerant collection operation will be described next with reference to FIG. 8. In the second outdoor unit (40) in the non-operating state, the second compressor (42) is operated, and both the second main three-way switching valve (45) and the second sub three-way switching valve (46) are set to the first state. Further, the second outdoor expansion valve (44) is closed fully. In this state, in the second outdoor unit (40), the second outdoor fan (47) is operated to supply outdoor air as a cooling fluid to the second outdoor heat exchanger (43).

Figure 8:
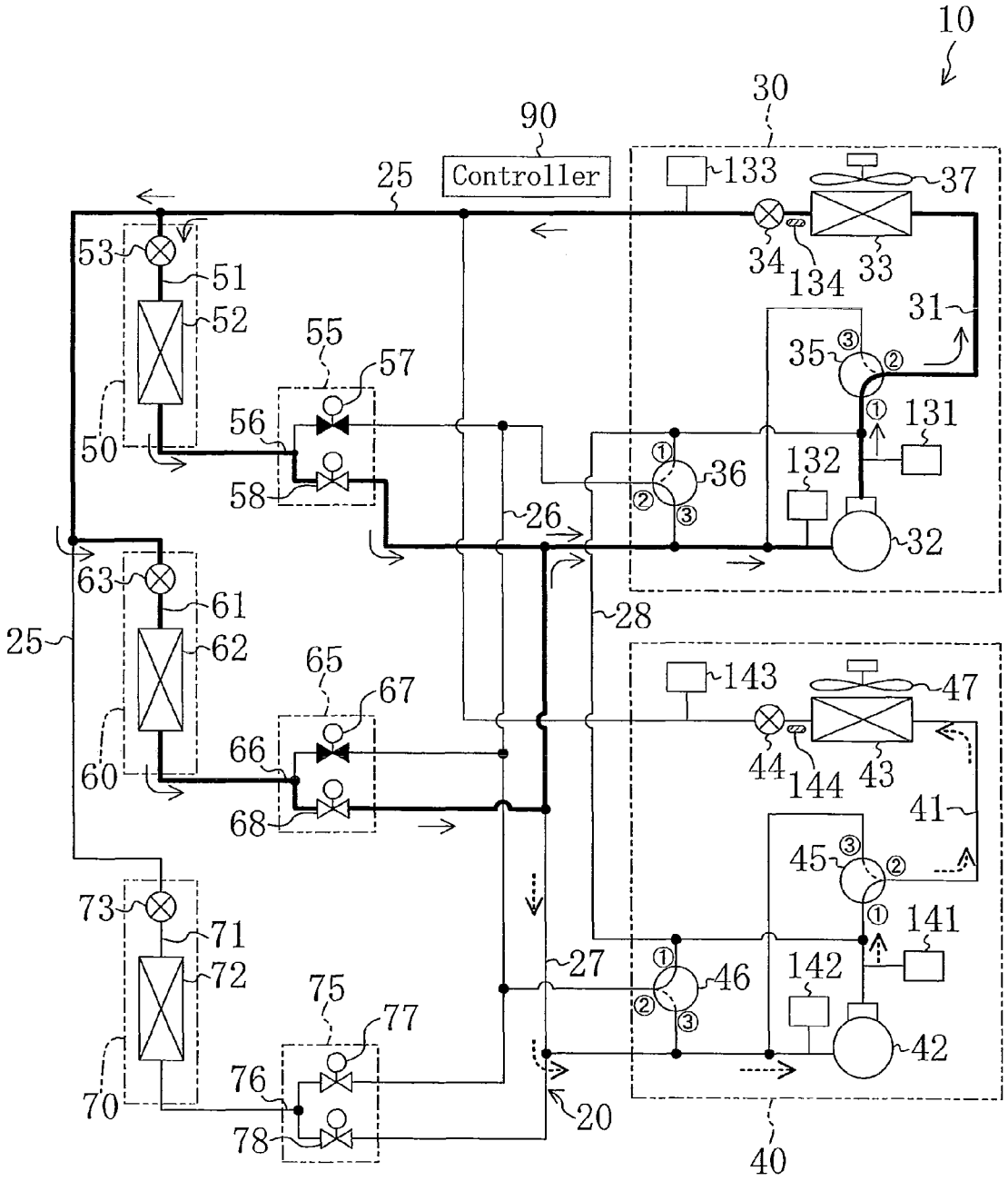
FIG. 8 is a refrigerant circuit diagram showing operation of the air conditioner in second refrigerant collection operation according to Example Embodiment 1.

In the refrigerant circuit (20) during the second refrigerant collection operation, part of the refrigerant flowing in the low pressure gas side pipe (27) flows as indicated by broken arrows in FIG. 8. Specifically, part of the refrigerant flowing in the low pressure gas side pipe (27) flows into the second outdoor circuit (41), and is sucked into the second compressor (42) to be compressed. The refrigerant discharged from the second compressor (42) passes through the second main three-way switching valve (45), and then flows into the second outdoor heat exchanger (43). In the second outdoor heat exchanger (43), the refrigerant flowing therein is cooled by the outdoor air supplied by the second outdoor fan (47) to be condensed. Since the second outdoor expansion valve (44) is closed fully, the refrigerant condensed in the second outdoor heat exchanger (43) remains retained in the second outdoor heat exchanger (43).

Here, when the amount of the refrigerant actually circulating in the refrigerant circuit (20) is excessive relative to the amount of the refrigerant necessary for performing the refrigeration cycle in the appropriate operation state, the amount of the refrigerant that the first outdoor heat exchanger (33) can condense is deficient relatively, with a result that the high pressure of the refrigeration cycle increases. Conversely, when the amount of the refrigerant actually circulating in the refrigerant circuit (20) is deficient relative to the amount of the refrigerant necessary for performing the refrigeration cycle in the appropriate operation state, the amount of the refrigerant that the first outdoor heat exchanger (33) can condense is excessive relatively, with a result that the high pressure of the refrigeration cycle decreases. In this way, the value of the high pressure of the refrigeration cycle varies according to excess or deficiency of the amount of the refrigerant circulating in the refrigerant circuit (20).

In view of this, in the air conditioner (10) during the low power operation, the controller (90) judges whether the refrigerant collection operation should be performed or not. The controller (90) monitors the detected value of the high pressure sensor (131, 141) provided in an outdoor unit (30, 40) in the operating state. When the detected value exceeds a predetermined reference value, the controller (90) judges that the amount of the refrigerant circulating in the refrigerant circuit (20) is excessive to cause the refrigerant collection operation to start. Specifically, in the examples shown in FIGS. 7 and 8, when the detected value of the first high pressure sensor (131) exceeds the reference value, the controller (90) activates the second outdoor fan (47) with the second outdoor expansion valve (44) closed fully so that the refrigerant is collected to and retained in the second outdoor heat exchanger (43) in the non-operating state.

Furthermore, in the air conditioner (10) during the refrigerant collect operation, the outdoor fan control section (91) of the controller (90) controls the operation of the outdoor fan (37, 47) provided in an outdoor unit (30, 40) in the non-operating state on the basis of the detected value of the high pressure sensor (131, 141) provided in an outdoor unit (30, 40) in the operating state. That is, in the examples shown in FIGS. 7 and 8, the outdoor fan control section (91) controls the operation of the second outdoor fan (47) so that the detected value of the first high pressure sensor (131) becomes a value within a predetermined target range.

Specifically, in the examples shown in FIGS. 7 and 8, when the detected value of the first high pressure sensor (131) is below the lower limit of the predetermined target range, the outdoor fan control section (91) stops the second outdoor fan (47). When the second outdoor fan (47) is stopped, the outdoor air is not supplied to the second outdoor heat exchanger (43), thereby decreasing the amount of the refrigerant condensed in the second outdoor heat exchanger (43). Accordingly, the amount of the refrigerant collected to the second outdoor heat exchanger (43) in the non-operating state decreases to reserve the amount of the refrigerant circulating in the refrigerant circuit (20). Conversely, when the detected value of the first high pressure sensor (131) is above the upper limit of the predetermined target range when the second outdoor fan (47) is stopped, the outdoor fan control section (91) activates the second outdoor fan (47) so that the outdoor air is supplied to the second outdoor heat exchanger (43), thereby increasing the amount of the refrigerant collected to the second outdoor heat exchanger (43).

In addition, in order to positively discharge the refrigerant from the second outdoor heat exchanger (43) in the non-operating state, the second main three-way switching valve (45) is set to the second state with the second outdoor fan (47) stopped. In this state, the refrigerant retained in the second outdoor heat exchanger (43) is sucked into the low pressure gas side pipe (27) via the second main three-way switching valve (45). Further, in this case, the second compressor (42) may be operated with the second outdoor expansion valve (44) opened so that the refrigerant discharged from the second compressor (42) can push out the refrigerant retained in the second outdoor heat exchanger (43) toward the liquid side pipe (25).

Advantages of Example Embodiment 1

According to the present example embodiment, the refrigerant collection operation is performed in the low power operation to collect and retain the refrigerant to and in an outdoor heat exchanger (33, 43) in the non-operating state. In other words, in the low power operation where the amount of the refrigerant necessary for performing the refrigeration cycle decreases, surplus refrigerant can be collected to and stored in an outdoor heat exchanger (33, 43) in the non-operating state. As a result, even without a receiver and an accumulator for adjusting the refrigerant amount in the refrigerant circuit (20), the refrigerant amount can be adjusted by utilizing an outdoor heat exchanger (33, 43) in the non-operating state. In other words, according to the present example embodiment, a receiver and an accumulator can be omitted from the refrigerant circuit (20).

Here, in general, receivers are provided at parts of the refrigerant circuit (20) where the high pressure refrigerant flows (e.g., parts of the outdoor circuits (31, 41) closer to the liquid side pipe (25) than the outdoor expansion valves (34, 44)) so as to retain thereinside high pressure liquid refrigerant. The temperature of the high pressure liquid refrigerant is usually higher than the outdoor temperature. Accordingly, the liquid refrigerant retained in the receivers may dissipate heat to the outdoor air around the receivers. For this reason, in the refrigerant circuit (20) with the receivers, part of the heat of the refrigerant may be lost in the receivers, thereby reducing the heat usable for indoor heating.

Furthermore, in general, accumulators are provided on the suction sides of the compressors (32, 42) in the refrigerant circuit (20). Therefore, the refrigerant retained in the accumulators is low pressure liquid refrigerant. The temperature of the low pressure liquid refrigerant is usually lower than the outdoor temperature. Accordingly, the liquid refrigerant retained in the accumulators may absorb heat from the outdoor air around the accumulators. For this reason, in the refrigerant circuit (20) with the accumulators, part of the cold heat of the refrigerant may be lost in the accumulators, thereby reducing the cold heat usable for indoor cooling.

Thus, the receivers in the refrigerant circuit (20) may lower the heating power, and the accumulators in the refrigerant circuit (20) may lower the cooling power. Further, provision of the receivers and the accumulators in the refrigerant circuit (20) can mean an increase in number of components in the refrigerant circuit (20), thereby increasing the manufacturing cost of the air conditioner (10). In contrast, according to the present example embodiment, the receivers and the accumulators can be omitted from the refrigerant circuit (20), thereby eliminating the disadvantages caused by providing the receives, such as a heat loss and a cost increase.

Moreover, by utilizing the fact that there is a correlation between excess and deficiency of the amount of the refrigerant circulating in the refrigerant circuit (20) and the high pressure of the refrigeration cycle, the outdoor fan control section (91) of the controller (90) in the present example embodiment controls the operation of the outdoor fans (37, 47) during the refrigerant collection operation on the basis of the detected values of the high pressure sensors (131, 141) (i.e., the value of the high pressure of the refrigeration cycle). This results in adjustment of the amount of the refrigerant collected to and retained in an outdoor heat exchanger (33, 43) in the non-operating state. Thus, according to the present example embodiment, the amount of the refrigerant can be appropriately adjusted by the refrigerant collection operation.

In the present example embodiment, the liquid pressure adjusting section (92) of the controller (90) adjusts the opening of the outdoor expansion valve (34, 44) corresponding to an outdoor heat exchanger (33, 43) functioning as a condenser to keep at given values or larger the difference between the high pressure of the refrigeration cycle and the pressure of the refrigerant in the liquid side pipe (25) and the difference between the pressure of the refrigerant in the liquid side pipe (25) and the low pressure of the refrigeration cycle. Accordingly, in the state where a plurality of heat exchangers function as evaporators in the refrigerant circuit (20), the opening adjustment of the expansion valves corresponding to the heat exchangers functioning as evaporators can appropriately adjust the amount of the refrigerant distributed to the heat exchangers functioning as evaporators. Further, in the state where a plurality of heat exchangers function as condensers in the refrigerant circuit (20), the opening adjustment of the expansion valves corresponding to the heat exchangers functioning as condensers can appropriately adjust the amount of the refrigerant distributed to the heat exchangers functioning as condensers.

Here, in the case where a receiver is provided at a part of the refrigerant circuit (20) communicating with the liquid side pipe (25), the receiver functions as a type of a buffer tank to cause the pressure of the refrigerant in the liquid side pipe (25) to vary slowly. For this reason, the response of the refrigerant pressure to change in opening of the expansion valves (34, 44) is extremely slow, thereby creating difficulty in appropriate control on the pressure of the refrigerant in the liquid side pipe (25). In contrast, in the present example embodiment, the refrigerant collection operation can adjust the amount of the refrigerant in the refrigerant circuit (20), thereby achieving omission of such a receiver from the refrigerant circuit (20). Thus, according to the present example embodiment, the liquid pressure adjusting section (92) of the controller (90) performs the predetermined control operation on the outdoor expansion valves (34, 44) of the refrigerant circuit (20) from which such a receiver is omitted, thereby achieving appropriate adjustment of the pressure of the refrigerant in the liquid side pipe (25).

Example Embodiment 2

Example Embodiment 2 of the present invention will be described next.

Figure 9:
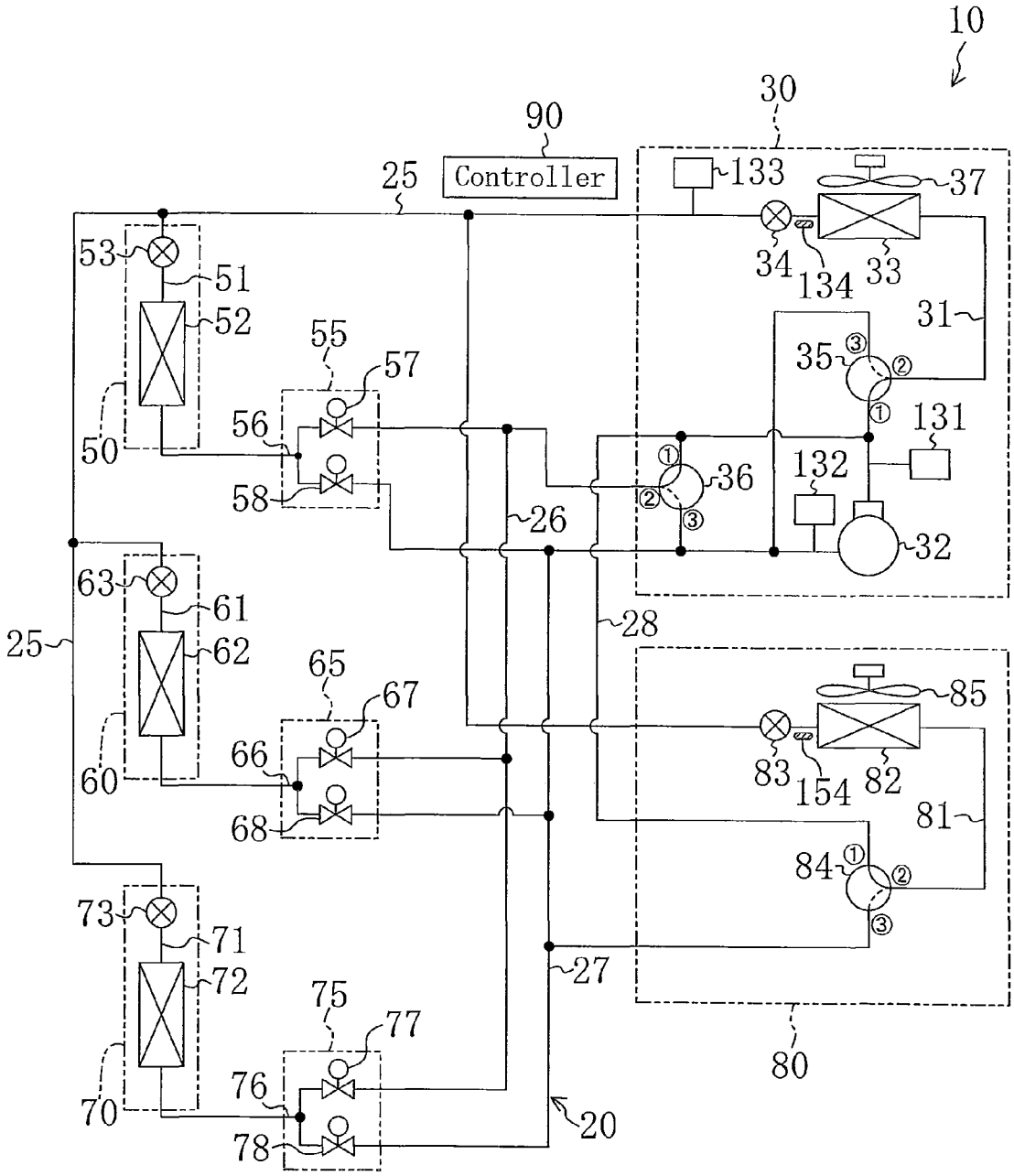
FIG. 9 is a refrigerant circuit diagram showing a configuration of a refrigerant circuit according to Example Embodiment 2.

As shown in FIG. 9, an air conditioner (10) according to the present example embodiment is provided with a heat exchanger unit (80) in place of the second outdoor unit (40) in the air conditioner (10) of Example Embodiment 1. Description will be given of only the difference of the air conditioner (10) of the present example embodiment from the air conditioner (10) of Example Embodiment 1.

The heat exchanger unit (80) includes an auxiliary circuit (81) and an auxiliary outdoor fan (85). The auxiliary circuit (81) includes an auxiliary outdoor heat exchanger (82) as a heat source side heat exchanger, an auxiliary outdoor expansion valve (83) as a heat source side expansion valve, and an auxiliary three-way switching valve (84). In the auxiliary circuit (81), the auxiliary heat exchanger (82) is connected at one end thereof to the second port of the auxiliary three-way switching valve (84), while being connected at the other end thereof to the auxiliary outdoor expansion valve (83). The auxiliary three-way switching valve (84) is connected at its first port to the connection pipe (28), while being connected at its third port to the low pressure gas side pipe (27). The other end of the auxiliary outdoor expansion valve (83) is connected to the liquid side pipe (25). The auxiliary outdoor expansion valve (83) serves as a flow rate adjusting mechanism configured to limit or block the refrigerant flow on the other end side of the auxiliary outdoor heat exchanger (82). The auxiliary outdoor expansion valve (83) serves as an opening variable adjusting valve.

The auxiliary outdoor heat exchanger (82) is configured by a fin and tube heat exchanger of cross fin type. The auxiliary outdoor heat exchanger (82) heat exchanges the outdoor air supplied by the auxiliary outdoor fan (85) with the refrigerant. The auxiliary outdoor fan (85) serves as an air blowing mechanism for supplying outdoor air to the auxiliary outdoor heat exchanger (82). The auxiliary three-way switching valve (84) is switched between a first state indicated by the solid line in FIG. 9 and a second state indicated by the broken line in FIG. 9. In the first state, the second port communicates with only the first port while being cut off from the third port. In the second state, the second port communicates with only the third port while being cut off from the first port.

The auxiliary circuit (81) includes an auxiliary refrigerant temperature sensor (154). The auxiliary refrigerant temperature sensor (154) is a thermistor attached to the refrigerant pipe, and is disposed in the vicinity of the end portion of the auxiliary outdoor heat exchanger (82) on the side of the auxiliary outdoor expansion valve (83). The auxiliary refrigerant temperature sensor (154) detects the temperature of the refrigerant flowing in the refrigerant pipe.

—Operation Mode—

The air conditioner (10) according to the present example embodiment performs, similarly to the air conditioner (10) of Example Embodiment 1, cooling operation, heating operation, and cooling/heating operation where some of the indoor units (50, 60, 70) perform(s) cooling while the other indoor unit(s) (50, 60, 70) perform(s) heating. Further, the air conditioner (10) according to the present example embodiment performs, in the operation mode where the heat exchanger unit (80) is in a non-operating state, refrigerant collection operation for collecting and retaining surplus refrigerant to and in the auxiliary outdoor heat exchanger (82). The cooling operation, the heating operation, and the refrigerant collection operation of the air conditioner (10) of the present example embodiment will be described herein.

<Cooling Operation>

Figure 10:
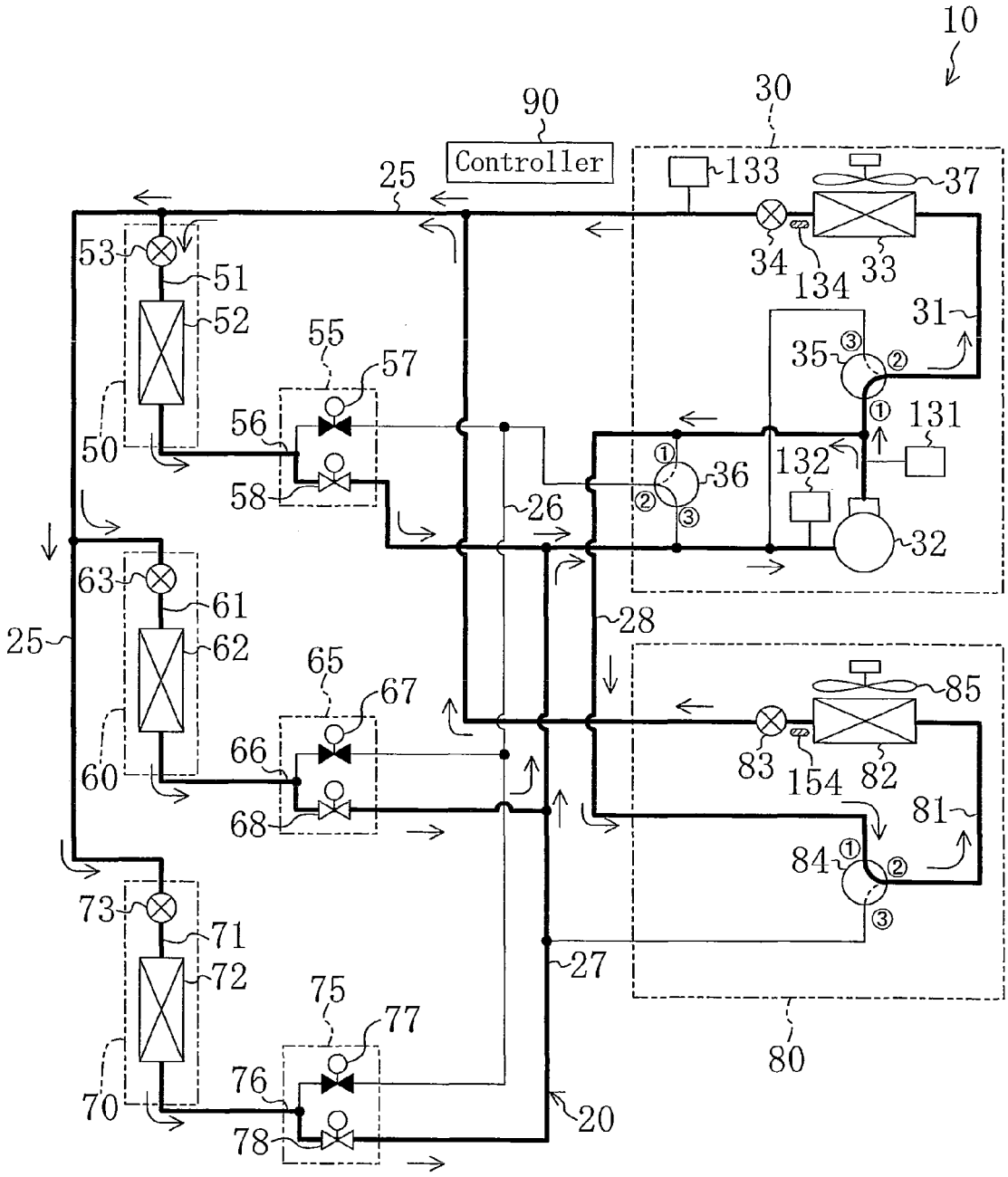
FIG. 10 is a refrigerant circuit diagram showing operation of an air conditioner in cooling operation according to Example Embodiment 2.

Cooling operation will be described in which all the indoor units (50, 60, 70) in the operating state perform cooling. Here, the case will be described with reference to FIG. 10 where the first outdoor unit (30), the heat exchanger unit (80), and all the indoor units (50, 60, 70) are operated.

In the cooling operation, in the heat exchanger unit (80), the auxiliary three-way switching valve (84) is set to the first state, and the auxiliary outdoor expansion valve (83) is opened fully. Further, the auxiliary outdoor fan (85) is operated. The operation states of the first outdoor unit (30), the indoor units (50, 60, 70), and the switching units (55, 65, 75) are the same as those in the cooling operation in Example Embodiment 1.

Part of the refrigerant discharged from the first compressor (32) passes through the first three-way switching valve (35), and then flows into the first outdoor heat exchanger (33). The other part of the refrigerant flows into the auxiliary circuit (81) through the connection pipe (28). The refrigerant flowing in the first outdoor heat exchanger (33) dissipates heat to outdoor air to be condensed, passes through the first outdoor expansion valve (34), and then flows into the liquid side pipe (25). On the other hand, the refrigerant flowing in the auxiliary circuit (81) passes through the auxiliary three-way switching valve (84), and then flows into the auxiliary outdoor heat exchanger (82). The refrigerant flowing in the auxiliary outdoor heat exchanger (82) dissipates heat to outdoor air to be condensed, passes through the auxiliary outdoor expansion valve (83), and then flows into the liquid side pipe (25).

The refrigerant flowing in the liquid side pipe (25) is distributed to the three indoor units (50, 60, 70). In the indoor units (50, 60, 70), the refrigerant flowing in the indoor circuits (51, 61, 71) is reduced in pressure by the indoor expansion valves (53, 63, 73), and then absorbs heat from indoor air in the indoor heat exchangers (52, 62, 72) to be evaporated. The indoor units (50, 60, 70) supply the air cooled in the indoor heat exchangers (52, 62, 72) indoors. The refrigerant evaporated in the indoor heat exchangers of the indoor circuits (51, 61, 71) passes through the low pressure side solenoid valves (58, 68, 78) of the corresponding switching circuits (56, 66, 76), flows into the low pressure gas side pipe (27), and then is sucked into the first compressor (32) of the first outdoor circuit (31) to be compressed.

<Heating Operation>

Figure 11:
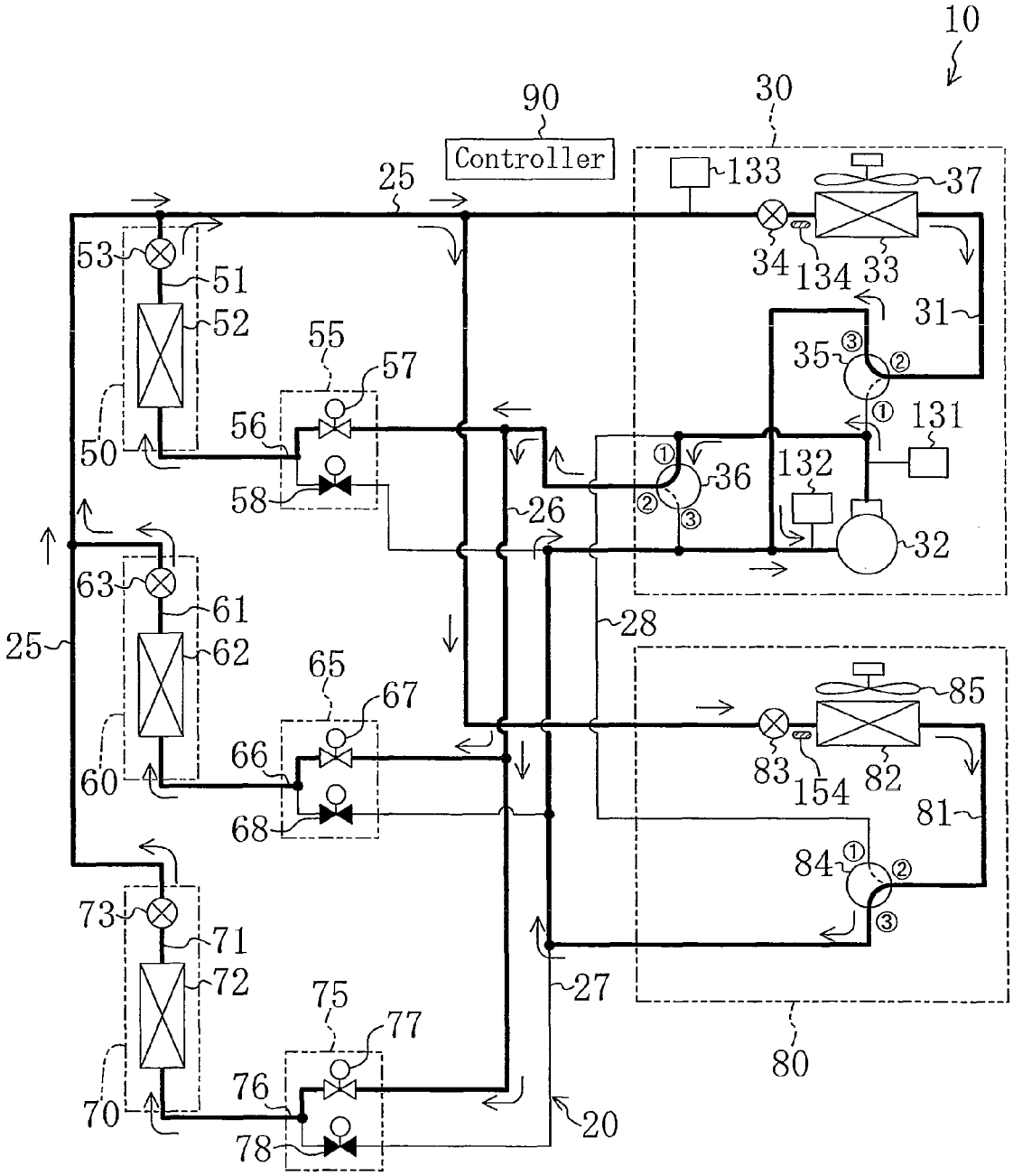
FIG. 11 is a refrigerant circuit diagram showing operation of the air conditioner in heating operation according to Example Embodiment 2.

Heating operation will be described in which all the indoor units (50, 60, 70) in operation perform heating. Here, the case will be described with reference to FIG. 11 where the outdoor unit (30), the heat exchanger unit (80), and all the indoor units (50, 60, 70) are operated.

In the heating operation, in the heat exchanger unit (80), the auxiliary three-way switching valve (84) is set to the second state, and the opening of the auxiliary outdoor expansion valve (83) is adjusted appropriately. Further, the auxiliary outdoor fan (85) is operated. The opening of the auxiliary outdoor expansion valve (83) is controlled so that the degree of superheat of the refrigerant at the outlet of the auxiliary outdoor heat exchanger (82) becomes constant. The states of the first outdoor unit (30), the indoor units (50, 60, 70), and the switching units (55, 65, 75) are the same as those in the heating operation in Example Embodiment 1.

In the first outdoor circuit (31), the refrigerant discharged from the first compressor (32) passes through the first sub three-way switching valve (36), and then flows into the high pressure gas side pipe (26). The refrigerant flowing in the high pressure gas side pipe (26) from the first outdoor circuit (31) is distributed to the three switching circuits (56, 66, 76). The refrigerant flowing in the switching circuits (56, 66, 76) passes through the high pressure side solenoid valves (57, 67, 77), and then flows into the corresponding indoor circuits (51, 61, 71). In the indoor circuits (51, 61, 71), the refrigerant flowing therein dissipates heat to indoor air in the indoor heat exchangers (52, 62, 72) to be condensed, passes through the indoor expansion valves (53, 63, 73), and then flows into the liquid side pipe (25). The indoor units (50, 60, 70) supply the air heated in the indoor heat exchangers (52, 62, 72) indoors.

Part of the refrigerant flowing in the liquid side pipe (25) flows into the first indoor circuit (31), and the other part of the refrigerant flows into the auxiliary circuit (81). The refrigerant flowing in the first outdoor circuit (31) is reduced in pressure when passing through the first outdoor expansion valve (34), absorbs heat from outdoor air in the first outdoor heat exchanger (33) to be evaporated, and then is sucked into the first compressor (32) to be compressed. The refrigerant flowing in the auxiliary circuit (81) is reduced in pressure when passing through the auxiliary outdoor expansion valve (83), absorbs heat from outdoor air in the auxiliary outdoor heat exchanger (82) to be evaporated, and then flows into the first outdoor circuit (31) through the low pressure gas side pipe (27). The refrigerant flowing in the first outdoor circuit (31) through the low pressure gas side pipe (27) is sucked into the first compressor (32) together with the refrigerant evaporated in the first outdoor heat exchanger (33) to be compressed.

<Refrigerant Collection Operation>

In the air conditioner (10) of the present example embodiment, the heat exchanger unit (80) may be in a non-operating state in the cooling operation, the heating operation, and the cooling/heating operation. The air conditioner (10) of the present example embodiment performs, as low power operation, an operation mode where the refrigeration cycle is performed by operating the first outdoor unit (30) with the heat exchanger unit (80) stopped.

Figure 12:
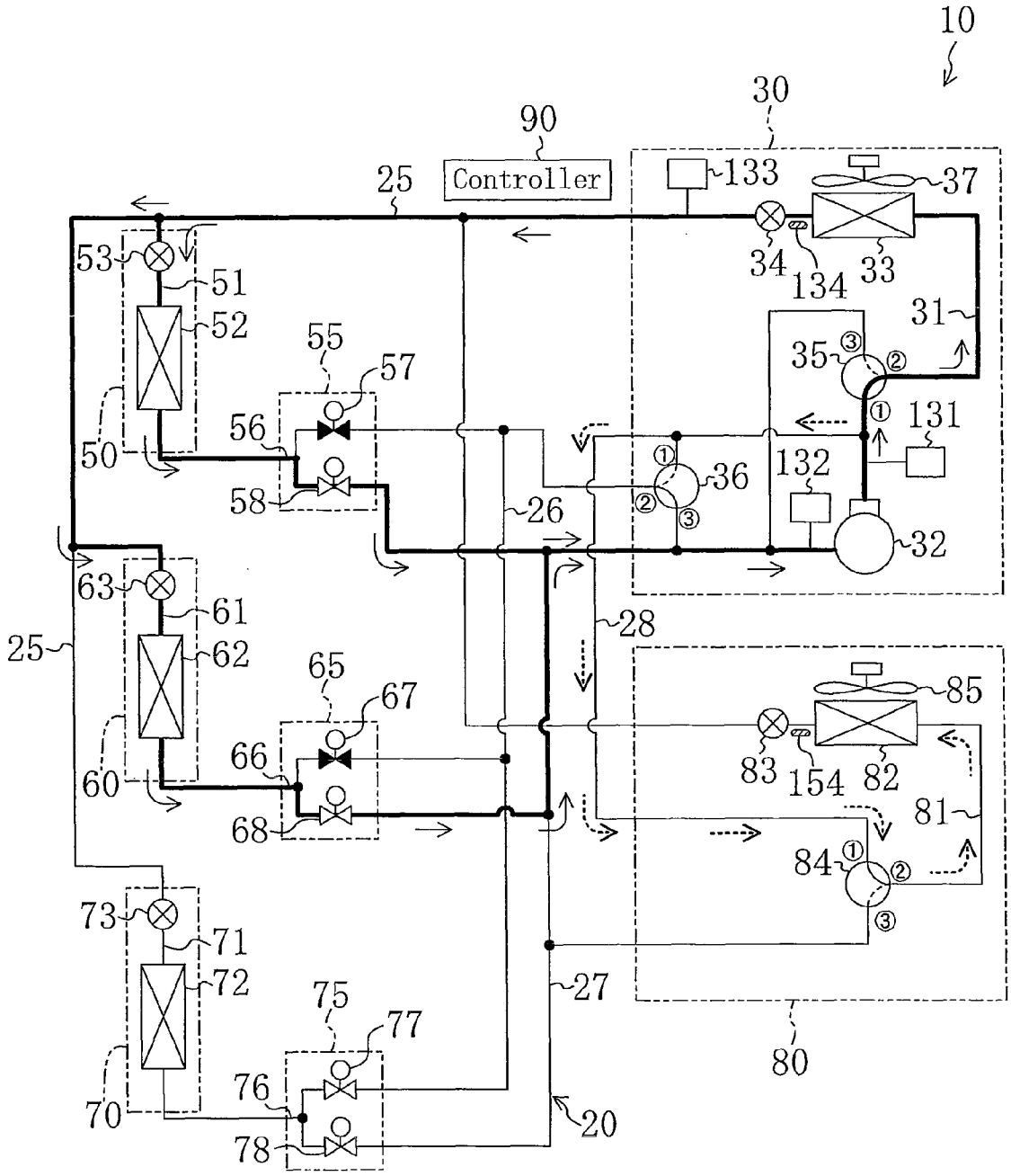
FIG. 12 is a refrigerant circuit diagram showing operation of the air conditioner in refrigerant collection operation according to Example Embodiment 2.
Figure 13:
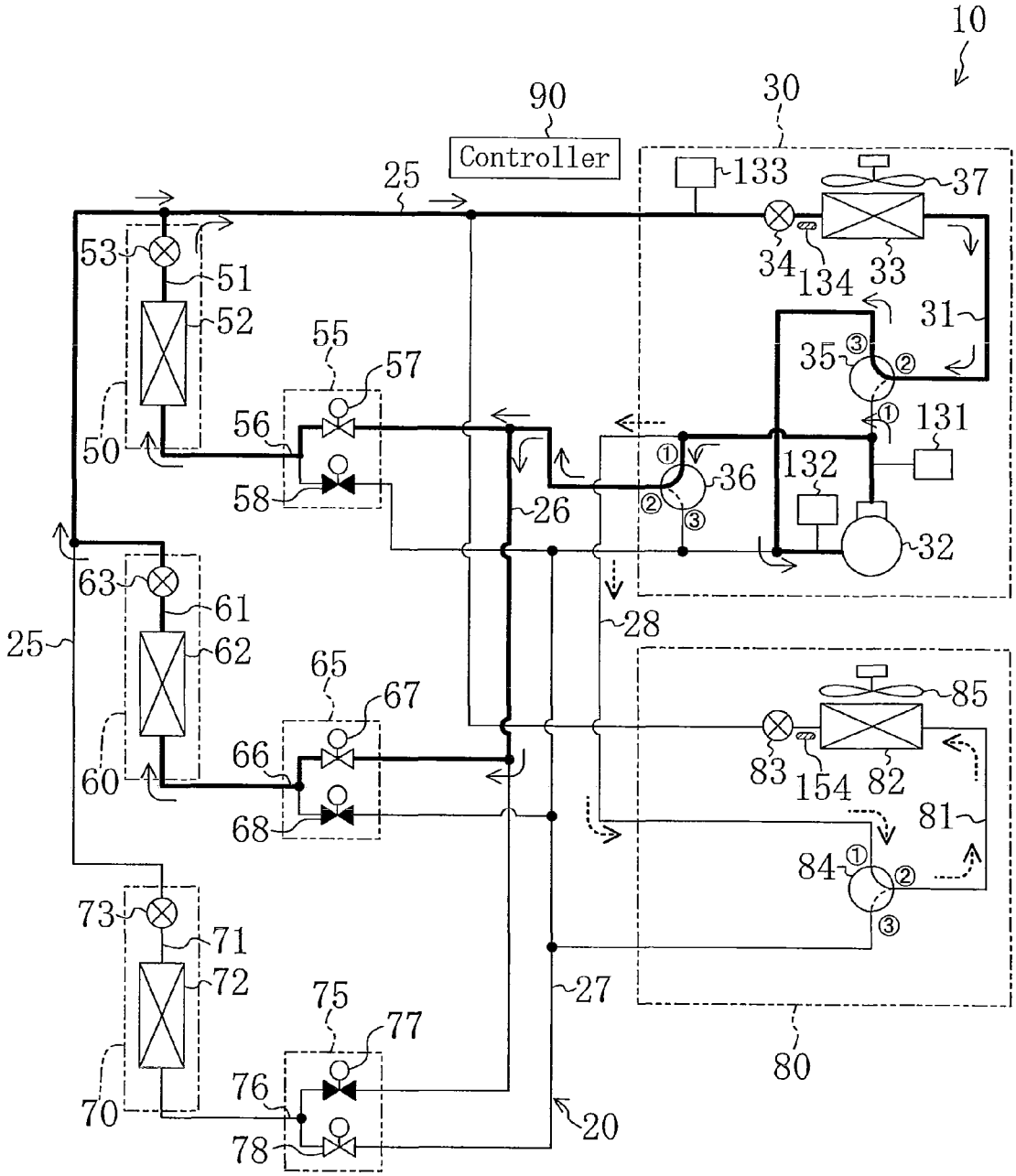
FIG. 13 is a refrigerant circuit diagram showing operation of the air conditioner in refrigerant collection operation according to Example Embodiment 2.
Figure 14:
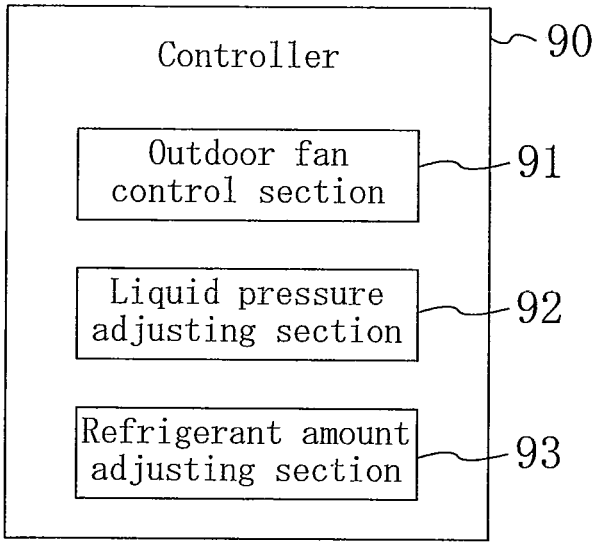
FIG. 14 is a block diagram showing a configuration of a controller according to Modified Example 4 in other example embodiments.

Similarly to the air conditioner (10) of Example Embodiment 1, the air conditioner (10) of the present example embodiment performs refrigerant collection operation in the low power operation to collect and retain surplus refrigerant to and in the auxiliary outdoor heat exchanger (82) in the non-operating state. Here, the refrigerant collection operation in the air conditioner (10) of the present example embodiment will be described with reference to FIGS. 12 and 13. FIG. 12 is a refrigerant circuit diagram showing the refrigerant collection operation in the cooling operation where the third indoor unit (70) is in the non-operating state. FIG. 13 is a refrigerant circuit diagram showing the refrigerant collection operation in the heating operation where the third indoor unit (70) is in the non-operating state.

As shown in FIGS. 12 and 13, in the heat exchanger unit (80) during the refrigerant collection operation, the auxiliary three-way switching valve (84) is set to the first state, and the auxiliary outdoor expansion valve (83) is closed fully. Further, the auxiliary outdoor fan (85) is operated. In addition, during the refrigerant collection operation in the heating operation, the third high pressure side solenoid valve (77) of the third switching unit (75) corresponding to the third indoor unit (70) in the non-operating state is closed (see FIG. 13).

In the refrigerant circuit (20) during the refrigerant collection operation, part of the refrigerant discharged from the first compressor (32) flows as indicated by the broken arrows in FIGS. 12 and 13. Specifically, part of the refrigerant discharged from the first compressor (32) flows into the auxiliary circuit (81) through the connection pipe (82), passes through the auxiliary three-way switching valve (84), and then flows into the auxiliary outdoor heat exchanger (82). In the auxiliary outdoor heat exchanger (82), the refrigerant flowing therein is cooled by the outdoor air supplied by the auxiliary outdoor fan (85) to be condensed. Since the auxiliary outdoor expansion valve (83) is closed fully, the refrigerant condensed in the auxiliary outdoor heat exchanger (82) remains retained in the auxiliary outdoor heat exchanger (82).

In the air conditioner (10) of the present example embodiment, the controller (90) also judges whether the refrigerant collection operation should be performed or not during the low power operation. Specifically, in the examples shown in FIGS. 12 and 13, the controller (90) monitors the detected value of the first high pressure sensor (131) provided in the first outdoor unit (30) in the operating state. When the detected value exceeds a predetermined reference value, the controller (90) judges that the amount of the refrigerant circulating in the refrigerant circuit (20) is excessive to cause the refrigerant collection operation to start. Specifically, when the detected value of the first high pressure sensor (131) exceeds the reference value, the controller (90) activates the auxiliary outdoor fan (85) with the auxiliary outdoor expansion valve (83) closed fully so that the refrigerant is collected to and retained in the auxiliary outdoor heat exchanger (82) in the non-operating state.

Furthermore, in the air conditioner (10) of the present example embodiment, during the refrigerant collect operation, the outdoor fan control section (91) of the controller (90) controls the operation of the auxiliary outdoor fan (85) provided in the heat exchanger unit (80) in the non-operating state on the basis of the detected value of the high pressure sensor (131) provided in the first outdoor unit (30) in the operating state. That is, in the examples shown in FIGS. 12 and 13, the outdoor fan control section (91) controls the operation of the auxiliary outdoor fan (85) so that the detected value of the first high pressure sensor (131) becomes a value within a predetermined target range.

Specifically, in the examples shown in FIGS. 12 and 13, when the detected value of the first high pressure sensor (131) is below the lower limit of the predetermined target range, the outdoor fan control section (91) stops the auxiliary outdoor fan (82). When the auxiliary outdoor fan (82) is stopped, the outdoor air is not supplied to the auxiliary outdoor heat exchanger (82), thereby decreasing the amount of the refrigerant condensed in the auxiliary outdoor heat exchanger (82). Accordingly, the amount of the refrigerant collected to the auxiliary outdoor heat exchanger (82) in the non-operating state decreases to reserve the amount of the refrigerant circulating in the refrigerant circuit (20). Conversely, when the detected value of the first high pressure sensor (131) is above the upper limit of the predetermined target range when the auxiliary outdoor fan (85) is stopped, the outdoor fan control section (91) activates the auxiliary outdoor fan (85) so that the outdoor air is supplied to the auxiliary outdoor heat exchanger (82), thereby increasing the amount of the refrigerant collected to the auxiliary outdoor heat exchanger (82).

In addition, in order to positively discharge the refrigerant from the auxiliary outdoor heat exchanger (82) in the non-operating state, the auxiliary three-way switching valve (84)

is set to the second state with the auxiliary outdoor fan (85) stopped. In this state, the refrigerant retained in the auxiliary outdoor heat exchanger (82) is sucked into the low pressure gas side pipe (27) via the auxiliary three-way switching valve (84). Alternatively, the auxiliary outdoor expansion valve (83) may be opened with the auxiliary three-way switching valve (84) set to the first state so that the high pressure refrigerant flowing from connection pipe (28) to the auxiliary circuit (81) can push out the refrigerant retained in the auxiliary outdoor heat exchanger (82) toward the liquid side pipe (25).

Other Example Embodiments

Modified Example 1

In each of the above example embodiments, the controller (90) judges whether the amount of the refrigerant circulating in the refrigerant circuit (20) is excessive or not on the basis of the detected values of the high pressure sensors (131, 141) during the low power operation. However, the controller (90) can judge excess and deficiency of the amount of the refrigerant circulating in the refrigerant circuit (20) on the basis of other parameters.

For example, in the operation states shown in FIGS. 7 and 8, when the amount of the refrigerant actually circulating in the refrigerant circuit (20) is excessive relative to the amount of the refrigerant necessary for performing the refrigeration cycle in the appropriate operation state, the amount of the liquid refrigerant present in the first outdoor heat exchanger (33) functioning as a condenser is large to increase the degree of subcooling of the refrigerant at the outlet of the first outdoor heat exchanger (33). Conversely, when the amount of the refrigerant actually circulating in the refrigerant circuit (20) is deficient relative to the amount of the refrigerant necessary for performing the refrigeration cycle in the appropriate operation state, the amount of the liquid refrigerant present in the first outdoor heat exchanger (33) functioning as a condenser is small to reduce the degree of subcooling of the refrigerant at the outlet of the first outdoor heat exchanger (33). Thus, the degree of subcooling of the refrigerant at the outlet of a heat exchanger functioning as a condenser varies according to excess or deficiency of the amount of the refrigerant circulating in the refrigerant circuit (20).

In view of this, in each of the above example embodiments, the controller (90) may monitor the degree of subcooling of the refrigerant at the outlet of the outdoor heat exchanger (33, 43) provided in an indoor unit (30, 40) in the operating state for judging whether the amount of the refrigerant circulating in the refrigerant circuit (20) is excessive or not.

The operation of the controller (90) will be described in the case where present modified example is applied to the air conditioner (10) of Example Embodiment 1. In the operation states shown in FIGS. 7 and 8, the controller (90) monitors the degree of subcooling of the refrigerant at the outlet of the first outdoor heat exchanger (33). When the degree of subcooling exceeds a predetermined reference value, the controller (90) judges that the amount of the refrigerant circulating in the refrigerant circuit (20) is excessive to cause the refrigerant collection operation to start. Further, the outdoor fan control section (91) of the controller (90) controls the operation of the second outdoor fan (47) provided in the second outdoor unit (40) in the non-operating state on the basis of the degree of subcooling of the refrigerant at the outlet of the first outdoor heat exchanger (33) provided in the first outdoor unit (30) in the operating state.

It is noted that the degrees of subcooling of the refrigerant at the outlets of the outdoor heat exchangers (33, 43) may be calculated by the following methods. That is, temperature sensors for detecting the refrigerant temperatures are provided at the inlets and the outlets of the outdoor heat exchangers (33, 43), and the differences between the detected values of the temperature sensors are used as measurement values of the degrees of subcooling of the refrigerant. Alternatively, the equivalent saturation temperatures of the refrigerant at the detected values of the high pressure sensors (131, 141) are calculated, and the values obtained by subtracting the actual measurement values of the refrigerant temperatures at the outlets of the outdoor heat exchangers (33, 43) from the equivalent saturation temperatures are used as the degrees of subcooling.

Modified Example 2

In each of the above example embodiments, the outdoor fan control section (91) of the controller (90) controls the outdoor fans (47, 85) on the basis of the detected value of the high pressure sensors (131, 141). In other words, the outdoor fan control section (91) uses "the pressure of the refrigerant discharged from a compressor" as "a physical quantity serving as an index indicating the high pressure of the refrigeration cycle." However, "the physical quantity serving as an index indicating the high pressure of the refrigeration cycle" is not limited to "the pressure of the refrigerant discharged from a compressor." For example, the outdoor fan control section (91) can use "the condensation temperature of the refrigerant in an outdoor heat exchanger (33, 43) in the operating state" as "the physical quantity serving as an index indicating the high pressure of the refrigeration cycle."

Modified Example 3

In each of the above example embodiments, the outdoor expansion valves (44, 83) of the units (40, 80) in the non-operating state are closed fully during the refrigerant collection operation. However, the outdoor expansion valves (44, 83) may not necessarily be closed fully. That is, if some amount of the liquid refrigerant can be retained in the outdoor heat exchangers (43, 82) in the non-operating state, the outdoor expansion valves (44, 83) provided at the one ends of the outdoor heat exchangers (43, 82) may be slightly opened. In this case, the liquid refrigerant flows little by little via the outdoor expansion valves (44, 83) from the outdoor heat exchangers (43, 82) in the non-operating state. However, the amounts of the liquid refrigerant flowing out from the outdoor heat exchangers (43, 82) are small when compared with the amount of the refrigerant circulating in the refrigerant circuit (20). Therefore, the outdoor heat exchangers (43, 82) in the non-operating state do not substantially function as condensers in the refrigeration cycle.

Modified Example 4

In each of the above example embodiments, the openings of the outdoor expansion valves (44, 83) of the units (40, 80) in the non-operating state may be adjusted during the refrigerant collection operation.

In the present modified example, a refrigerant amount adjusting section (93) is provided in the controller (90). The refrigerant amount adjusting section (93) receives the detected values obtained in the high pressure sensors (131, 141) and the detected values obtained in the refrigerant temperature sensors (134, 144, 154).

The refrigerant amount adjusting section (93) controls the opening of the outdoor expansion valve (44, 83) corresponding to an outdoor heat exchanger (43, 83) in the non-operating state on the basis of the degree of subcooling of the refrigerant flowing out from the outdoor heat exchanger (43, 82) in the non-operating state so that the amount of the liquid refrigerant retained in the outdoor heat exchanger (43, 82) in the non-operating state can be kept at a predetermined value. The refrigerant amount adjusting section (93) serves as subcooling degree detecting means for detecting the degree of subcooling of the refrigerant flowing out from the outdoor heat exchanger (43, 82) in the non-operating state, in addition to the high pressure sensors (131, 141) and the refrigerant temperature sensors (134, 144, 154).

For example, in the operation states shown in FIGS. 7 and 8, the refrigerant amount adjusting section (93) calculates the degree of subcooling of the liquid refrigerant flowing out from the second outdoor heat exchanger (43) in the non-operating state with the use of the detected value of the second high pressure sensor (141) and the detected value of the second refrigerant temperature sensor (144). Specifically, the refrigerant amount adjusting section (93) calculates the saturation temperature of the refrigerant at the detected value of the second high pressure sensor (141), and subtracts the detected value of the second refrigerant temperature sensor (144) from the calculated saturation temperature, thereby calculating the degree of subcooling of the refrigerant. Then, the refrigerant amount adjusting section (93) adjusts the opening of the second outdoor expansion valve (44) so that the calculated degree of subcooling of the refrigerant becomes a predetermined target value. Specifically, the refrigerant amount adjusting section (93) increases the opening of the second outdoor expansion valve (44) when the calculated degree of subcooling of the refrigerant is above the target value, and reduces the opening of the second outdoor expansion valve (44) when the calculated degree of subcooling of the refrigerant is below the target value.

Furthermore, in the operation states shown in FIGS. 12 and 13, the refrigerant amount adjusting section (93) calculates the degree of subcooling of the liquid refrigerant flowing out from the auxiliary outdoor heat exchanger (82) in the non-operating state with the use of the detected value of the first high pressure sensor (131) and the detected value of the auxiliary refrigerant temperature sensor (154). Specifically, the refrigerant amount adjusting section (93) calculates the saturation temperature of the refrigerant at the detected value of the first high pressure sensor (131), and subtracts the detected value of the auxiliary refrigerant temperature sensor (154) from the calculated saturation temperature, thereby calculating the degree of subcooling of the refrigerant. Then, the refrigerant amount adjusting section (93) adjusts the opening of the auxiliary outdoor expansion valve (83) so that the calculated degree of subcooling of the refrigerant becomes a predetermined target value. Specifically, the refrigerant amount adjusting section (93) increases the opening of the auxiliary outdoor expansion valve (83) when the calculated degree of subcooling of the refrigerant is above the target value, and reduces the opening of the auxiliary outdoor expansion valve (83) when the calculated degree of subcooling of the refrigerant is below the target value.

Here, the degrees of subcooling of the refrigerant flowing out from the outdoor heat exchangers (43, 82) in the non-operating state vary according to the amounts of the liquid refrigerant retained in the outdoor heat exchangers (43, 82) in the non-operating state. Specifically, as the amounts of the refrigerant retained in the outdoor heat exchangers (43, 82) in the non-operating state are increased, the degrees of subcooling of the refrigerant flowing out therefrom increase. Conversely, as the amounts of the refrigerant retained in the outdoor heat exchangers (43, 82) in the non-operating state are decreased, the degrees of subcooling of the refrigerant flowing out therefrom decrease.

Thus, the degrees of subcooling of the refrigerant flowing out from the outdoor heat exchangers (43, 82) in the non-operating state serve as indices indicating the amounts of the refrigerant retained in the outdoor heat exchangers (43, 82) in the non-operating state. In view of this, the refrigerant amount adjusting section (93) of the present modified example adjusts the opening of the outdoor expansion valve (44, 83) corresponding to the outdoor heat exchanger (43, 82) in the non-operating state so that the degree of subcooling of the refrigerant flowing out from the outdoor heat exchanger (43, 82) in the non-operating state can be kept at a predetermined target value. As a result, retention of a predetermined amount of the liquid refrigerant in the outdoor heat exchanger (43, 82) in the non-operating state can be ensured, thereby achieving appropriate setting of the amount of the refrigerant circulating in the refrigerant circuit (20). It is noted the target value of the degree of subcooling of the refrigerant in the refrigerant amount adjusting section (93) may be always constant or may be changed according to the operation condition.

Modified Example 5

In Modified Example 4, the refrigerant amount adjusting section (93) may control the opening of the outdoor expansion valve (44, 83) corresponding to the outdoor heat exchanger (43, 82) in the non-operating state on the basis of the degree of subcooling of the refrigerant flowing out from the outdoor heat exchanger (33) in the operating state. The refrigerant amount adjusting section (93) in the present modified example serves as subcooling degree detecting means for detecting the degree of subcooling of the refrigerant flowing out from the outdoor heat exchanger (33) in the operating state, in addition to the high pressure sensors (131, 141) and the refrigerant temperature sensors (134, 144, 154).

For example, in the operation states shown in FIGS. 7 and 8, the refrigerant amount adjusting section (93) calculates the degree of subcooling of the liquid refrigerant flowing out from the first outdoor heat exchanger (33) functioning as a condenser with the use of the detected value of the first high pressure sensor (131) and the detected value of the first refrigerant temperature sensor (134). Specifically, the refrigerant amount adjusting section (93) calculates the saturation temperature of the refrigerant at the detected value of the first high pressure sensor (131), and subtracts the detected value of the first refrigerant temperature sensor (134) from the calculated saturation temperature, thereby calculating the degree of subcooling of the refrigerant. Then, the refrigerant amount adjusting section (93) adjusts the opening of the second outdoor expansion valve (44) so that the calculated degree of subcooling of the refrigerant becomes a predetermined target value. Specifically, when the calculated degree of subcooling of the refrigerant is above the target value, the refrigerant amount adjusting section (93) reduces the opening of the second outdoor expansion valve (44) to increase the amount of the refrigerant retained in the second outdoor heat exchanger (43). On the other hand, when the calculated degree of subcooling of the refrigerant is below the target value, the refrigerant amount adjusting section (93) increases the opening of the second outdoor expansion valve (44) to reduce the amount of the refrigerant retained in the second outdoor heat exchanger (43).

Furthermore, in the operation states shown in FIGS. 12 and 13, the refrigerant amount adjusting section (93) calculates the degree of subcooling of the liquid refrigerant flowing out from the first outdoor heat exchanger (33) functioning as a condenser with the use of the detected value of the first high pressure sensor (131) and the detected value of the first refrigerant temperature sensor (134). Specifically, the refrigerant amount adjusting section (93) calculates the saturation temperature of the refrigerant at the detected value of the first high pressure sensor (131), and subtracts the detected value of the first refrigerant temperature sensor (134) from the calculated saturation temperature, thereby calculating the degree of subcooling of the refrigerant. Then, the refrigerant amount adjusting section (93) adjusts the opening of the auxiliary outdoor expansion valve (83) so that the calculated degree of subcooling of the refrigerant becomes a predetermined target value. Specifically, when the calculated degree of subcooling of the refrigerant is above the target value, the refrigerant amount adjusting section (93) reduces the opening of the auxiliary outdoor expansion valve (83) to increase the amount of the refrigerant retained in the auxiliary outdoor heat exchanger (82). On the other hand, when the calculated degree of subcooling of the refrigerant is below the target value, the refrigerant amount adjusting section (93) increases the opening of the auxiliary outdoor expansion valve (83) to reduce the amount of the refrigerant retained in the auxiliary outdoor heat exchanger (82).

Here, the degree of subcooling of the refrigerant flowing out from an outdoor heat exchanger (33) in the operating state functioning as a condenser varies according to the amount of the liquid refrigerant retained in the outdoor heat exchanger (33) in the operating state. Additionally, the amount of the refrigerant retained in the outdoor heat exchanger (33) in the operating state varies according to the amount of the refrigerant circulating in the refrigerant circuit (20). Specifically, when the amount of the refrigerant circulating in the refrigerant circuit (20) is larger than an appropriate value, the amount of the refrigerant retained in the outdoor heat exchanger (33) functioning as a condenser becomes is too large, with a result that the degree of subcooling of the refrigerant flowing out therefrom is too high. Conversely, when the amount of the refrigerant circulating in the refrigerant circuit (20) is smaller than the appropriate value, the amount of the refrigerant retained in the outdoor heat exchanger (33) functioning as a condenser is too small, with a result that the degree of subcooling of the refrigerant flowing out therefrom is too low.

Thus, the degree of subcooling of the refrigerant flowing out from an outdoor heat exchanger (33) in the operating state functioning as a condenser serves as an index indicating excess or deficiency of the amount of the refrigerant circulating in the refrigerant circuit (20). In view of this, the refrigerant amount adjusting section (93) in the present modified example adjusts the opening of the outdoor expansion valve (44, 83) corresponding to the outdoor heat exchanger (43, 82) in the non-operating state according to the degree of subcooling of the refrigerant flowing out from the outdoor heat exchanger (33) in the operating state. As a result, the amount of the refrigerant retained in the outdoor heat exchanger (43, 82) in the non-operating state can be kept securely at a predetermined amount, thereby achieving appropriate setting of the amount of the refrigerant circulating in the refrigerant circuit (20). It is noted that the target value of the degree of subcooling of the refrigerant in the refrigerant amount adjusting section (93) may be always constant or may be changed according to the operation condition.

Modified Example 6

In each of the above example embodiments, the outdoor heat exchangers (33, 43, 82) provided as heat source side heat exchangers in the refrigerant circuit (20) are, but are not necessarily, disposed in the individual units. For example, a plurality of outdoor heat exchangers may be connected in parallel to a single outdoor circuit installed in a single outdoor unit.

Modified Example 7

In each of the above example embodiments, the outdoor heat exchangers (33, 43, 82) for heat exchanging the refrigerant with outdoor air are provided as heat source side heat exchangers in the refrigerant circuit (20). Alternatively, heat exchangers for heat exchanging the refrigerant with, for example, water may be provided as the heat source side heat exchangers in the refrigerant circuit (20). In this case, cooling water cooled in, for example, a cooling tower is supplied as the cooling fluid to the heat source side heat exchangers.

The above example embodiments are merely preferred examples, and are not intended to limit the scopes of the present invention, its applicable objects, and its use.

INDUSTRIAL APPLICABILITY

As described above, the present invention is useful for refrigerating apparatuses including a plurality of heat source side heat exchangers in refrigerant circuits.

The invention claimed is:

1. A refrigerating apparatus, comprising: a refrigerant circuit including a plurality of outdoor units each having a compressor and a heat source side heat exchanger, and a plurality of indoor units each having a user side heat exchanger, the outdoor units and the indoor units connected to one another, wherein the refrigerating apparatus is configured to perform a refrigeration cycle in the refrigerant circuit, each of the outdoor units includes: a heat source side expansion valve for adjusting a flow rate of refrigerant in one end side of the heat source side heat exchanger of each of the outdoor units; and a high pressure sensor for detecting a pressure of the refrigerant, which is in a state of high pressure, discharged from the compressor of each of the outdoor units; the refrigerating apparatus is capable of performing low power operation in which, in each of some of the outdoor units, the compressor is in an operating state, and in at least one of the others of the outdoor units, the compressor is in a non-operating state, and refrigerant collection operation for collecting and retaining refrigerant to and in a non-operating heat exchanger, which is the heat source side heat exchanger of one of the outdoor units having the compressor in the non-operating state in the low power operation, by supplying a cooling fluid for cooling the refrigerant to the non-operating heat exchanger, the operation being performed in a state where refrigerant flow on one end side of the non-operating heat exchanger is limited or blocked by the heat source side expansion valve of one of the outdoor units having the compressor in the non-operating state in the low power operation, while refrigerant flow on another end side of the non-operating heat exchanger is communicating with a discharge side of the compressor in the operating state in the low power operation, a controller configured to adjust, during the refrigerant collection operation, a flow rate of the cooling fluid supplied to the non-operating heat exchanger on the basis of a detected value of the high pressure sensor of one of the outdoor units having the compressor in the operating state during the refrigerant collection operation.

2. The apparatus of claim 1, wherein the heat source side heat exchanger of each of the outdoor units is configured to heat exchange the refrigerant with outdoor air, each of the outdoor units has an outdoor fan provided for supplying outdoor air to the heat source side heat exchanger of each of the outdoor units, and the controller is configured to adjust, during the refrigerant collection operation, a flow rate of the outdoor air supplied as the cooling fluid to the non-operating heat exchanger by controlling operation of the outdoor fan of one of the outdoor units having the compressor in the non-operating state.

3. The apparatus of claim 1, wherein the refrigerant collection operation collects and retains refrigerant to and in the heat source side heat exchanger of one of the outdoor units having the compressor in the non-operating state without a receiver to collect and retain refrigerant therein in the low power operation.

4. A refrigerating apparatus, comprising:

a refrigerant circuit including a compressor, a plurality of heat source side heat exchangers, and at least one user side heat exchanger connected to one another, wherein the refrigerating apparatus is capable of performing low power operation for performing a refrigeration cycle in the refrigerant circuit in a state where at least one of the heat source side heat exchangers is in a non-operating state, and refrigerant collection operation for collecting and retaining refrigerant to and in the heat source side heat exchanger in the non-operating state in the low power operation, and the refrigerant circuit includes multiple ones of the at least one user side heat exchanger, heat source side expansion valves provided one by one at one ends of the heat source side heat exchangers, user side expansion valves provided one by one at one ends of the user side heat exchangers, and a liquid side pipe having one branching end connected to the heat source side expansion valves, and another branching end connected to the user side expansion valves, the apparatus comprising:

a controller configured to perform, in an operation state where at least one of the heat source side heat exchangers functions as a condenser, adjustment of an opening of a heat source side expansion valve that corresponds to the heat source side heat exchanger functioning as a condenser in response to a sensed high side pressure of the refrigerant cycle, a sensed pressure of the refrigerant in the liquid side pipe and a sensed low side pressure of the refrigerant cycle, so that a difference between the sensed high side pressure of the refrigeration cycle and the sensed pressure of the refrigerant in the liquid side pipe is equal to or larger than a predetermined first reference value and a difference between the sensed pressure of the refrigerant in the liquid side pipe and the sensed low side pressure of the refrigeration cycle is equal to or larger than a predetermined second reference value.

5. The apparatus of claim 4, wherein the refrigerant collection operation collects and retains refrigerant to and in the heat source side heat exchanger in the non-operating state without a receiver to collect and retain refrigerant therein in the low power operation.

* * * * *